US008376246B2

(12) United States Patent
White et al.

(10) Patent No.: US 8,376,246 B2
(45) Date of Patent: Feb. 19, 2013

(54) NOVELTY DRINKING STRAW WITH FLOW REGULATOR

(76) Inventors: Francetta Jamese Estes White, Hilton Head Island, SC (US); David Lawrence White, Hilton Head Island, SC (US)

( * ) Notice: Subject to any disclaimer, the term of this patent is extended or adjusted under 35 U.S.C. 154(b) by 526 days.

(21) Appl. No.: 12/460,366

(22) Filed: Jul. 17, 2009

(65) Prior Publication Data

US 2011/0011946 A1 Jan. 20, 2011

(51) Int. Cl.
*A47G 21/18* (2006.01)

(52) U.S. Cl. ..... 239/33; 239/16

(58) Field of Classification Search ..... 239/33, 239/16, 24

See application file for complete search history.

(56) References Cited

U.S. PATENT DOCUMENTS 4,379,511 A * 4/1983 del Fabro ..... 215/388
5,160,087 A * 11/1992 Mandell ..... 239/33
5,211,335 A * 5/1993 Strid ..... 239/110
5,595,325 A * 1/1997 Leres ..... 222/135
6,360,912 B1 * 3/2002 Lee ..... 220/705
6,742,681 B1 * 6/2004 Yang ..... 222/509
8,025,242 B2 * 9/2011 Efremkin et al. ..... 239/33
2001/0028003 A1 * 10/2001 Katsukawa ..... 239/33
2006/0169791 A1 * 8/2006 Taylor et al. ..... 239/33
2010/0019007 A1 * 1/2010 Wagner ..... 224/148.2

OTHER PUBLICATIONS www.hiltonheadcontainer.com © .

* cited by examiner

*Primary Examiner* — Davis Hwu

(57) ABSTRACT

A reusable or confectionery drinking straw includes a second end portion mouthpiece having a single aperture or multiple apertures, the sensation of the liquid flowing through the aperture(s) capable of being modified by the user. The mouthpiece of the straw device is integral to the straw or it may be removably attached to the straw. The drinking straw device may be edible, partially edible, or inedible. The drinking straw device may be in the form of a bracelet, which may be edible, partially edible, or inedible.

21 Claims, 15 Drawing Sheets

NOVELTY DRINKING STRAW WITH FLOW REGULATOR

CROSS REFERENCE TO RELATED DOCUMENT

Benefit is claimed under 35 USC 119(e) of provisional U.S. patent application No. 60/653,721, filed on Feb. 17, 2005, and application Ser. No. 11/356/605, filed on Feb. 17, 2006.

BACKGROUND OF THE INVENTION

1. Technical Field

The present device relates generally to a reusable or confectionery drinking straw whose novelty involves the sensory effects created by the number, size, shape, or placement of apertures, and the user's ability to modify the effects by manipulation of the device.

2. Background Information

There have been many attempts to develop novel ways to imbibe liquids with a drinking straw. Drinking straws have in the past been sold separately from the container, or they are attached to, and purchased with, a beverage container.

In their simplest configuration, drinking straws are freestanding, simple vertical tubes. Over the years, there have been many modifications to the simple vertical tube. In two such modifications found in prior art, Katsukawa (U.S. Pat No.6,585,170 B2) and Mandell (U.S. Pat. No.5,160,087), use a visual element, a heart-shaped design, to illustrate their inventive concept. Taylor (US 2006/0169791 A1) proposes a drinking straw device that is a tube that is partially edible. This prior art discloses a method of manufacture to combine an outer layer of liquid resistant paper wrapper with an inner layer of edible material, such as flavored food, medicine, or candy. The first and second end mouthpieces of Taylor are identical. That is, the inventive concept of the manufacture of the device is tubular from beginning to end to allow "a small number of components which can be manufactured economically in volume resulting in a relatively low unit cost" Taylor. Another such example is the invention of Lee (U.S. Pat. No. 6,360,912). Lee modifies the freestanding, simple vertical tube by creating a device that actually prevents the flow of liquid to the mouth of the user. Lee uses a valve for opening and closing the straw. He creates a device having a totally internal valve that is capable "of adjusting the flow rate of the beverage being spouted through the straw while keeping the taste and aroma of the beverage, preventing foreign matters from being introduced into the container, and preventing the beverage from being unintentionally spouted from the container due to an impact applied to the container." While these inventions serve their respective purposes for mass production and low cost, none creates a reusable or confectionery device that allows the user to create a personalized stream of liquid to enter the mouth in a manner that is particularized to the sensory desires of the user through the use of a regulator that modifies the location or the sensation of the flow of the liquid thatpasses through the mouthpiece. Nor is there an objective in Katsukawa, Lee, Mandell, or Taylor of using the mouthpiece of the drinking straw in combination with other elements of the drinking straw, such as the size, number, shape, and placement of mouthpiece apertures, and the shape of the mouthpiece, the straw cap, or the bore In more complex configurations, drinking straws are freestanding, ornamental straws that spiral, loop, or bend in ways that draw the user's attention to the flow of the contents through the straw as the beverage is sipped. The ornamental configurations of drinking straws currently available, such as the heart shape of Katsukawa, may be seen as attempts to improve the passive entertainment value of the straw to the user, while creating a method of manufacturing. However, the prior art of Mandrell represents a novel approach to the entertainment value of drinking straws. The device's inventive concept is to foster teamwork, and therefore, requires at least two persons to operate the device. Mandell does not work, then, with use by one person since individualism is not the objective. Therefore, there remains a need for a drinking straw that is freestanding (or capable of use independently) with a more active entertainment value, and where a single user has variable control over the sensual (i.e., visual, tactile, taste, and smell) drinking experience as he or she uses the straw.

In other configurations, a straw with a movable extension, usually made of plastic, is built into the cap of a beverage container. The user pulls up the movable extension of the straw from its horizontal position on the cap of the container, and extracts the contents. The straw is stored by replacing the movable extension of the straw back into its horizontal position on the cap of the container.

In yet other configurations, the drinking straw is purchased with the container, but is removable from the container The container is designed to allow the straw to fit through a hole in the lid of the container This straw remains in a near vertical position when in use or in storage. In some of these configurations, the straw has a removable cap molded around a base of the straw that can fit over the straw. The removable cap for the straw is designed to snap onto the straw when the straw is not in use, so as to keep the straw clean. There is a need, however, to improve the functionality of the removable cap, i.e., for a removable cap that also functions as a supplemental straw appurtenance. By "supplemental straw appurtenance," it is meant that the removable cap is a physical extension of the drinking straw in functionality, in that the cap, by user preference, is a part of the device to extract the contents from a container in a novel and unique stream of liquid to the mouth of the user.

As with all drinking straws, the drinking straw device of the current invention can be used to imbibe the contents of a beverage container from either end of the straw. While all drinking straws can be used to imbibe the contents of a beverage container from either end of the straw, not all inventive concepts of drinking straws allow the contents to be sent to the mouth from either end of the straw. The prior art of del Fabro (U.S. Pat. No. 4,379,511) is illustrative of an inventive concept that allows the liquid contents in the drinking straw to be sent to the mouth from either end of the straw. Del Fabro creates a drinking straw with a floatation element sandwiched between two open tubes, allowing the device to "extend upwardly . . . a distance sufficient to permit normal usage." Either end of the device may be used as the mouthpiece without compromising the inventive concept. On the other hand, the straw device of Efremkin (U.S. Pat. No. 8,025,242 B2) is a drinking straw device that takes in liquid from a container only from a pre-determined depth (5-15 mm) from the top of the liquid, so as to have minimal negative biological effects. The inventive concept of Efremkin, then, allows the use of only one end of the device as a mouthpiece, rather than the use of both ends as mouthpieces. The distal end of the Efremkin device comprises multiple apertures. But to achieve Efremkin's inventive concept, the multiple apertures must remain submerged in the liquid when in use, and the liquid must remain undisturbed to ensure that intake is from a predetermined depth from the top of the liquid. Unlike the Efremkin device, however, the current invention allows either end of the drinking straw device to be used. The end of the straw with multiple apertures can be used to deliver a novel stream of liquid to the mouth of the user when the apertures are placed in the mouth. Alternatively, when an end of the drinking straw device of the current invention with multiple apertures or with an enlarged end is placed in the beverage, the straw also can be an excellent mechanism for creating added turbulence for better stirring of the beverage—a functionality that is not available with Efremkin's inventive concept.

The drinking straw device of the current invention is designed for a sustainable environment. Currently, the majority of commercially available drinking straws are ubiquitous, mass produced straight tubes that are marketed for limited or one time use., and are discarded at the end of their use. There is a need for a drinking straw concept that will encourage multiple reuse through an improvement in functionality, i.e., through improvements in the active entertainment value of the device that can be altered at the whim or desire of the user over multiple uses. That is, the current invention is constructed for multiple uses (reusable), and is manufactured of a reusable material such as flexible tubing, hard or soft plastic, or other resins, stainless steel, composite material, sterling silver, or any other suitable renewable composite or natural material. It is anticipated that the device will be cleaned by the purchaser or consumer in a dishwasher or by hand. Furthermore, it's price point for manufacture would allow it to be personalized to the sensory preference of the user. In other words, the current invention requires a somewhat higher price point than most commercialized straws on the market which are produced for mass consumption without regard for, or the capability for, modifying the drinking experience to the desires of the user while the drinking straw is in use. The current inventive concept advances environmental sustainability in that it ensures that each drinking straw in use has greater longevity in reuse, and advances the use of the drinking straw as a fourth piece of cutlery, thereby joining the ranks of the knife, fork, and spoon.

It is known that the intensity of the flow of liquid to the mouth of the user is dependent upon several factors, among which are the thickness of the beverage, the number, size, shape, placement, or angle of the aperture or apertures, and the strength of the suction applied by the user. The object of this invention is to provide a drinking straw that can provide a novel drinking experience that uses the number, size, shape, or placement of the aperture to deliver a unique sensation to the user's palate. In other words, where the strength of the suction applied by the user and the thickness of the beverage are held constant, the drinking experience from the novelty drinking straw of the current invention is predicated upon the sensation created by the number, size, shape, angle, or placement of the aperture or apertures on the mouthpiece of the drinking straw, and their manipulation by the user according to the user's preference. Unlike the device of Lee, the current invention allows the user to manipulate the sensation of the liquid flow. With Lee, the user is not allowed to manipulate the sensation of the liquid flow, but is allowed either to open or to close the device so that liquid either flows or does not flow through the straw. The liquid that passes through an end portion of the straw device of the current invention flows in a unique spray or stream of liquid to the mouth of the user. The mouthpiece of the current device may be at either end or at both ends of the straw.

By "mouthpiece" is meant the generally accepted definition of an object that in normal use is placed in the mouth, or the piece or part of an object to which the mouth is applied or that is held in the mouth. The mouthpiece of the current invention is in direct fluid communication with the mouthpiece at the opposite end of the device. The end of the straw mouthpiece of the current invention may consist of a single aperture, or may consist of multiple apertures. The multiple apertures of the current invention may be of the same shape or different shapes; the same size, or different sizes. Furthermore, the multiple apertures on the mouthpiece of this invention may be constructed at any angle, or in any position, shape, or size, and may be in any combination of shapes, position, and/or sizes. The shape of the aperture, also, may be simple or complex, for example, having a kaleidoscope-type visual effect through light refraction or through other variation in visual effect.

The current device, in its totality, may be simple or complex, i.e., shaped in a geometric form, or in the shape of a plant (vegetable, fruit, flower, tree, etc.), bird, fowl, fish, or other mammal, mineral, cartoon character, or any other object. (See FIG. 1A vs. FIG. 4A.) Since the drinking straw device can be made of any reusable material, such as plastic, silver, stainless steel, or a suitable form of paper, the exterior form of the device may be molded, brazed or welded, as appropriate, onto the exterior shaft of the straw. The material contemplated for more formal and informal, novelty table or bar straws would be manufactured of stainless steel or other hard material suitable for dining or bar use, where the material can be cleaned and sanitized for reuse in a manner similar to other cutlery or flatware. The drinking straw device alternatively can be made of a suitable candy material. The entire device may be completely edible or it may be partly edible. For example, the second end portion mouthpiece may be edible, and the first end portion mouthpiece may be edible or not. Where the second end portion mouthpiece is made of a candy material, the suctioned flow of the stream of candy-flavored liquid up and through the single aperture of the first end portion mouthpiece, through the shaft, to the aperture(s) of the second end portion mouthpiece, forms a stream or streams of the candy-flavored liquid that passes out of the second end portion aperture(s), creating a novel burst of liquid stream(s) to the palate of the user. In a more complex configuration or embodiment, the visual and olfactory sensation (as enhanced by the shape, color, taste, feel, or smell of the device) could be made to correspond with, enhance, or complement the oral sensation, as for example with FIG. 1B.

Previous efforts at developing straws were for passive entertainment or visual value alone, or they used modifications that targeted only the ends of the straw, mostly by using a rounded configuration for the mouthpiece or its aperture(s). Almost all use a rounded configuration for the internal construction of the bore, which is the cavity within the shaft of the straw. However, it is well known that shapes and images create pleasurable perceptions through their association with past experiences or known connotations. It is, therefore, another objective of the current invention to provide a sensory experience that carries through from the visual component of the drinking straw. Consequently, in addition to modifications of the external shape of the device, the drinking straw of the current device applies a modification to the internal shape of the bore. Specifically, the shape of the bore is carried through to the end portions of the straw, creating a visual experience that directly influences the intensity of the sensory perception or excitement in the drinking experience because of its association with pleasurable images. The internal shape of the bore that is carried through to the mouthpiece aperture directly influences the sensation from the drinking experience, just as the external shape of the mouthpiece and the mouthpiece aperture influence the sensation of the drinking experience. See, for example, FIGS. 1A, 1B, 4A, and 4B.

It also is an objective of this invention to create a reusable straw device that provides a more active source of entertainment. The current invention provides, then, a novel flow of liquid to the user's mouth by enhancing the variation in the intensity or sensation of the beverage flow through the use of an integral beverage flow regulator (hereafter called a regulator or flow regulator) that modifies the location or the sensation of the flow of the liquid that passes through an end portion of the straw device to the mouth of the user. Where the drinking straw device is manufactured in a plastic material that is pliable, the user simply could use his or her fingers to squeeze the device to modify or manipulate the sensation created by the device's aperture(s), creating an even more intense sensation than ordinarily would be available. However, there also is the need for a device that can alter the sensation when the material used for construction is not so pliable. In this instance, the user could use the integral flow regulator of the current invention. With the integral regulator, the user can further modify the direction of the liquid flow or modify the liquid sensation to his or her mouth by manipulating or rotating the external component of the flow regulator. At the operator's choice, the flow regulator is configured to control the number, size, shape, or angle of apertures through which the fluid flows, and thereby, the direction of the liquid flow. The valve, then, allows a change in the direction, location, or sensation of the flow of liquid without the necessity of removing and replacing the mouthpiece. Consequently, in addition to the variation in liquid flow created by the number, size, shape, angle, or placement of the apertures, then, this invention allows the user, by using a regulator, to further vary the intensity or sensation of the flow of liquid to suit the user's own preference, and/or for the region of the mouth to be targeted for the desired or selected sensation. FIG. 9C is an example of a flow regulator (valve) configured to change the desired sensation through manipulation of the device. A change in the number, size, shape, angle, or combination of apertures open or closed creates a change in the direction, intensity or sensation of the liquid in the mouth of the user. The device of the current invention with its regulator may be of one-piece or two-piece construction, and in its simplest form may be removably attached to the drinking straw, as in FIG. 5D. The regulator may be fully external, as in FIGS. 1B, 5D, and 7B, or partially internal (consist of an internal and an external component), such as with FIG. 1A, 1B, and 2C. The flow regulator is integrally constructed preferably of the same material as the straw device, and may be manufactured for placement on either or both ends of the straw device, or at any point along the straw's shaft. The introduction of a flow regulator would permit more sophisticated sensations such as a spray mist or oscillating liquid sensations. Finally, either the regulator, or a stationary protuberance constructed in the fashion of the fully external regulator, is a convenient way to demarcate the location on the straw device where the lips would rest on and encircle the mouthpiece securely. This is important since with the more complex shapes and embodiments of the device of the current invention, the location of the mouthpiece may not be readily apparent, such as with FIG. 4B.

The regulator of the current invention is, in effect, a valve that is capable of being opened and closed by the user in increments to suit the user's preference, by the user's manipulation of the external component of the regulator. A variety of valves may be utilized, including but not limited to screw-activated, diaphragm, and pinch valves. Where the regulator comprises an exterior component only, any of the clamp-type valve devices currently available in the marketplace to selectively adjust or regulate the amount of flow of liquids through flexible tubing would suffice. Where the regulator comprises an interior and an exterior component, the interior component connects, through an opening in the wall of the straw device, to the exterior component. The external component of the valve may be in the form of a dial or disk, a lever, a push-pull (tab) mechanism, or any other method for manipulation commonly found in the marketplace. The user, for example, through the use of a rotating disk on an exterior wall of the straw device, modifies the intensity or sensation of the flow of the liquid through the straw device's aperture or apertures, as the case may be. As with a conventional valve, the user modifies the liquid flow by manipulating an exterior component. Unless the regulator is manufactured specifically to use air passage to stop the flow of liquid from the bore to the mouthpiece, it is important that the external portion of the regulator or valve be constructed so that air does not enter the device at its point of attachment to the drinking straw device. The integral, adjustable beverage flow regulator may be constructed with an internally rotating disk or an internally sliding plate so as to selectively adjust, modify, or regulate the flow of liquid. The internally sliding plate may have different apertures or an aperture to enhance or complement the apertures through which the liquid normally flows to the user from the bore of the shaft to the mouthpiece of the straw device. For example, with a sliding plate, the user can open or close off the flow of liquid to the device's selected mouthpiece aperture(s). In its open or unlocked position, liquid flows unimpeded to and through the bore through the selected mouthpiece aperture(s). In its closed or locked position, no liquid flows through the mouthpiece aperture(s).

Alternatively, and for a drinking straw device with a single mouthpiece aperture, the regulator could have an external disk component and an internally rotating (adjustable) disk component with a potential for a kaleidoscope of apertures, as FIGS. 4A and 4B. The internally rotating disk component may have apertures of a single size (FIG. 2D) or of different sizes (FIG. 2B), or of the same shape (FIG. 2D) or of different shapes (FIG. 2B), with different angles, or in random (FIGS. 4C, 6A) or non-random placement, or in any combination of the foregoing attributes. As with the regulator described in, this embodiment of the regulator is constructed so that the user manipulates an external component, such as a disk, tab, clamp, screw, or lever. However, in one embodiment the component of the regulator that is constructed on an exterior wall of the device connects internally to the regulator's internally rotating disk with multiple apertures. Using the external component of the regulator, the user creates variations in sensation or intensity by modifying the types or number of apertures engaged.

In yet another embodiment of the regulator, the drinking straw device of the current invention could have a rotating arm constructed along an interior wall of the chosen mouthpiece of the device, as in FIG. 7A. The rotating arm moves along an interior wall of the mouthpiece and is capable of limiting the flow of liquid to a single aperture or to multiple apertures. In its full open position, the rotating arm would allow unimpeded flow of liquid to and through the aperture(s). The rotating arm may be constructed to close off the flow of liquid from a single aperture or from multiple apertures, depending upon the user's preference. The internally constructed rotating arm is manipulated externally by the user through any number of commercially available mechanisms, such as a lever or a screw-like appurtenance or attachment, that connect the rotating arm to the external component of the straw device.

To assist in keeping the straw sanitary when not in use, the drinking straw device may have a rigid or flexible drinking straw cover or cap, preferably made of the same material as the straw device, such as plastic or metal that fits over the external portion of the mouthpiece through a snap or screw mechanism. The drinking straw cap of the current invention, however, is a drinking straw cap regulator; it is removably attached to the straw device, and is removable at the user's whim. The cap regulator has an improved functionality. That is, the cap regulator has multiple apertures, thereby being capable of further altering the flow of liquid from the selected end of the straw or of the selected mouthpiece that it covers, as in FIG. 1B. In this embodiment, the cap becomes an alternative or supplemental mouthpiece, the straw device preferably being of two-piece construction.

As the user sips from the straw device of the current invention, the rush of liquid from the first end portion of the straw device to the palate through strategically- or randomly-placed aperture or apertures in the chosen mouthpiece provides a new experience for the user, who receives a novel drinking sensation through a burst (meaning a single stream of liquid breaks apart to become a multiple stream) of liquid that is exciting, yet sensually pleasing to the palate and desires of the user.

The drinking straw of the current invention can be made from any suitable fibrous on non-fibrous material, such as metal, hard or flexible tubing, plastic, resin, and a suitable, reusable paper product. The present invention can be manufactured for use separately, or can be manufactured for use as an integral part of a novelty container.

Furthermore, the invention may be manufactured so that the selected mouthpiece of the device is either fixed or movable. Whether the selected mouthpiece of the current invention is fixed or movable, when in use both ends of the straw device are in direct fluid communication with each other. In one embodiment of its movable form, the mouthpiece of the straw device is retractable, capable of being extended and retracted at the desire of the user, such as in FIGS. 4B and 5A. This feature of the current invention allows a greater variety of novelty straws to be manufactured, since the shape of the mouthpiece of the more complex-shaped device may be uncomfortable to place entirely in one's mouth without an extendable/retractable feature. The user simply holds the straw with the fingers of one hand, and using the fingers of the second hand, manipulates the straw device such that, in effect, the straw device lengthens. The user, then, positions the smaller component of the mouthpiece (hereinafter called a supplemental mouthpiece) for more convenient use. In another embodiment of the device, the movable mouthpiece may be rotated for the purpose of opening or closing the aperture(s), as described above. In all of the embodiments above, however, the user places his or her mouth around the second end portion mouthpiece, sips the liquid which flows through the aperture of the first end portion mouthpiece. Where the second end portion mouthpiece consists of multiple apertures, the liquid continues to move up and through the shaft to the second end portion mouthpiece, and out through the second end portion mouthpiece apertures, sending multiple streams of liquid to the mouth of the user, and creating a novel sensation as the single stream of liquid passes through the multiple apertures as separate streams of liquid.

In another effort to improve the comfort of utilizing the straw of the current invention which may take any number of forms, the device has a new feature called a lip rest. The lip rest is a circular protuberance, preferably, made of the same material as the drinking straw device, and has a circumference that is slightly less than the circumference of the second end portion mouthpiece at its widest point. The lip rest encircles and is attached to the exterior wall of the shaft. The lip rest, in essence, is a ledge upon and above which the lip of the user comfortably rests to form a tight seal with the shaft, when the user's mouth is placed around the second end portion mouthpiece. In some embodiments of the current invention, the external portion of the regulator may function as a lip rest, as well.

Any portion of the current invention may be enlarged (bulbous), in the shape of a geometric figure, plant, animal, mineral, cartoon character, or of any other object. The drinking straw device of the current invention may be substantially straight or may be bent into any other suitable shape that still allows fluid to pass through the bore. The bore may have a consistent inside diameter/perimeter, or the inside diameter/perimeter of the bore may taper off at either end. The inside diameter/perimeter of the bore may be equal to, greater than, or less than the inside diameter/perimeter of the aperture at either end of the device. The outside dimensions of the drinking straw device may vary, and the location of the bore within the shaft of the device may be centered or not.

One challenge of the current invention is to create a novel drinking straw device of different outside features, dimensions, shapes and/or sizes without sacrificing the draw (suctioning capability) of the device. For example, the internal area of the selected mouthpiece where it connects with the upper end of the bore must remain in direct fluid communication with the opposite mouthpiece, and not be so large as to dissipate the liquid's flow more than desired. To prevent this, the straw device may be integrally formed by molding, brazing, or welding the desired shape around the exterior of the straw's shaft in order to maintain the desired flow of liquid to the mouthpiece. This would remove the likelihood that the draw or sensation would be dissipated unintentionally by the shape of the device.

As a separately purchased straw device, the present invention can become a standard piece of cutlery or flatware used in formal or informal indoor and outdoor dining settings, depending upon the material used for manufacturing the device. Sterling silver, stainless steel, or other metals are the preferable material for use in formal and informal indoor and outdoor dining settings. One advantage of the current invention is that in its simplest and most elegant configuration, it can be cleaned and sanitized for reuse in a fashion similar to other cutlery. Another objective of the current invention is to provide a straw device that would be suitable as the fourth piece of cutlery (or flatware as it may be called), along with the knife, fork, and spoon. Furthermore, the current invention could be used as chopsticks are used, but with the added functionality of a device where both liquid and solid contents may be enjoyed using one standard utensil, as with FIGS. 6A and 6B.

The straw of the current invention is also suitable for use as a novelty confection. Lollipops are solid, hard candy or they contain "treats" that have been stored within the body cavity of the candy. With the current invention, the straw device is made of lollipop confection of any flavor. The instant confectionery straw can itself flavor a beverage through which the user sips the liquid.

In the confectionery form of the current invention, the drinking straw can be entirely edible, or only partially edible, depending upon the composition of the materials used to support the confection. The normally jaded lollipop user will have a novel confection that also can be used in a new and different way—to increase their pleasurable drinking experience as the device dissolves into, and blends with, their favorite beverage. For example, where the second end portion mouthpiece of the current invention is a confection, stirring it in the beverage imparts some of it to the surrounding fluid, particularly where the beverage is hot or warm in temperature. When the confectionery second end portion mouthpiece is in the mouth, however, the user's saliva will more efficiently dissolve the confection into the user's mouth, so the user receives both the taste of the beverage and the taste of the confection on his or her taste buds. More specifically, when in use as a confectionery device, the second end portion mouthpiece is in direct fluid communication with the aperture of the first end portion mouthpiece, so that a suctioned flow of the stream of liquid up and through the aperture of the first end portion mouthpiece, through the bore, through the plurality of apertures of the second end portion mouthpiece, forms separate streams of the flavored liquid that passes out of the second end apertures, creating a novel burst of multiple liquid flavored streams to the palate of the user. With the current invention, then, the liquid mixes with the candy flavor of the second end portion mouthpiece prior to entering the mouth of the user. Before this invention, the flavor of the candy mixed with the liquid after the liquid entered the mouth of the user, rather than before the liquid entered the mouth of the user. Alternatively, with the current invention the user may chose to suck on the candy second end portion even without using it to imbibe a beverage.

The drinking straw of the current invention would be suitable for adults as a singular, novelty gift item, as a bar straw, or as souvenirs, favors, or commemoratives, for example, at wedding receptions. Children also will be delighted to carry their own private drinking straws of the present invention, which are shaped in the form of a bracelet. The drinking straw bracelet is preferably made of a pliable material, such as plastic, that can be flexed to form a circular configuration (FIGS. 1A, 1B) on a drinking container (not pictured), or around the child's arm (not pictured). The drinking straw is preferably in a novelty shape, such as an land animal (FIG. 2B), aquatic animal (FIG. 2C), plant (FIGS. 5A-D), or a cartoon character (FIG. 8). In any of these and other embodiments such as a Christmas tree, or a carrot or celery stick, the straw can be made from single or multiple colors for carrying and use, for example, at amusement parks. or for children as a party favor, for example, at a child's birthday party.

BRIEF SUMMARY OF THE INVENTION

The present invention is a drinking straw device that provides a novel flow of liquid to the user's mouth through variations in the sensation or intensity of the beverage flow through a single aperture or through multiple apertures in the straw's mouthpiece, where the flow of the liquid through the mouthpiece can be manipulated by the user to the user's preference by use of an externally constructed component of the straw device.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1A:
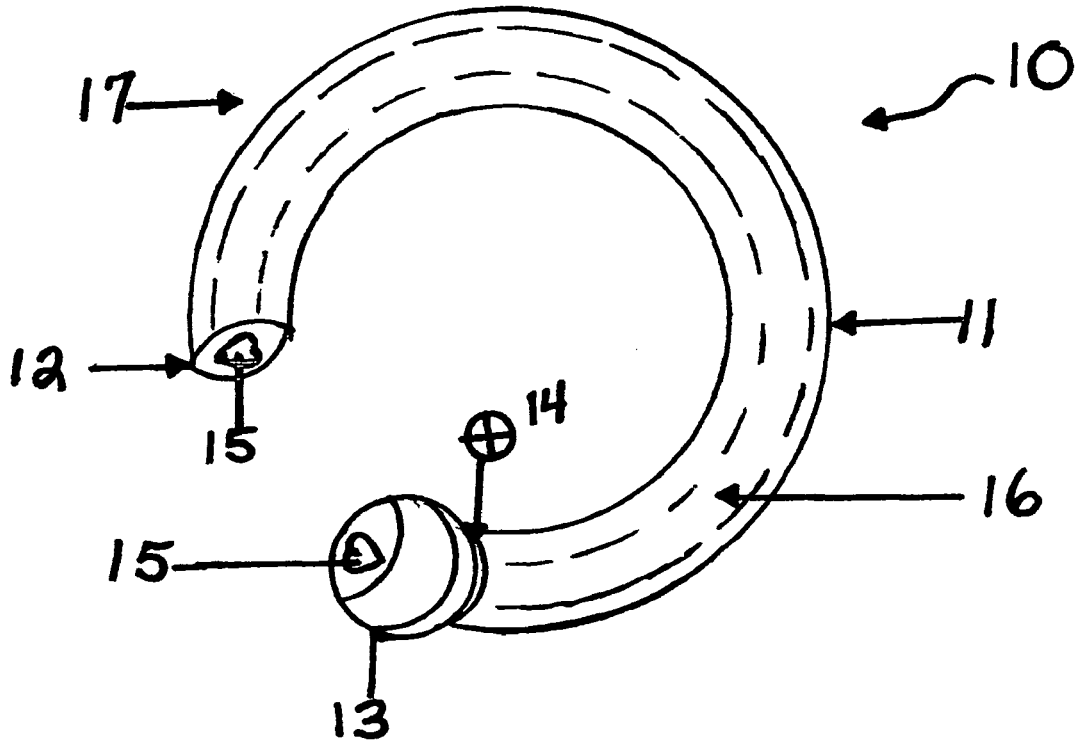
FIG. 1A is a perspective view of a drinking straw device according to the present invention.

In the following description, like reference characters designate like or corresponding parts throughout the several views. Also, in the following description, it is to be understood that such terms as "inside", "outside", "within", and the like are words of convenience and are not to be construed as limiting terms. Referring in more detail to the drawings, the invention will now be described.

In this application, the word, "manipulate," takes the primary, commonly used meaning that is defined as: "to handle, move, operate or use with the hands." Furthermore, since either end of a drinking straw, including the drinking straw of this invention, can be used for imbibing a liquid, this application uses in its description the nomenclature, "first end . . . ," to refer to the end of the straw that is placed in the liquid contents of the container. The "second end ... " refers, then, to the end of the device that is placed in the user's mouth. Furthermore, for this application, the liquid passes through a hole or defined cavity in the drinking straw called a "bore." The bore may be centrally located within the drinking straw device or may not be so centrally located. Finally, in this application the external shape of the drinking device does not have to be the same as the shape of the bore.

Figure 1B:
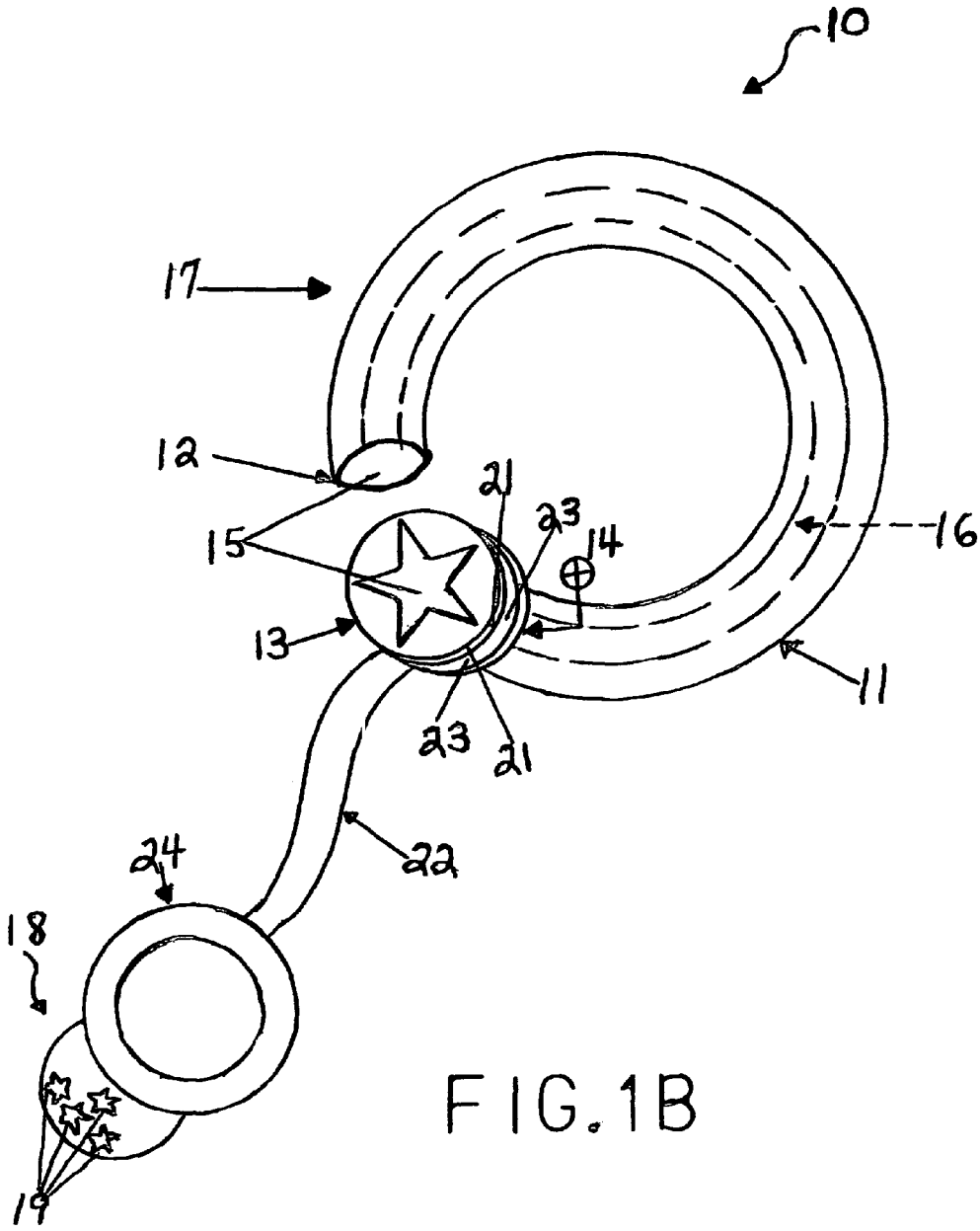
FIG. 1B is a perspective view of a drinking straw device according to the present invention, in the form of a bracelet.

The drinking straw device of the current invention may be inedible, or partially or fully edible, depending upon the embodiment. Referring to FIGS. 1A and 1B, a drinking straw device 10 is made up of a shaft 11 with a first end portion mouthpiece 12 connecting to an end of the second end portion mouthpiece 13. The shaft 11, with its internal bore 16, may be about the same in diameter/perimeter from one end to the other, or may be slightly larger or smaller. Similarly, the diameter/perimeter of the bore 16 of the shaft 11 may be about equal, or may be larger or smaller, at either end. The drinking straw device 10 may have a single aperture 15 or multiple apertures 15 at either or both ends of the device. The apertures 15 of the second end portion mouthpiece 13 preferably are in direct, fluid communication with the bore 16, so that beverage imbibed from the first end portion mouthpiece 12 of the drinking straw device 10 flows through the bore 16 of the shaft 11 to and through the aperture(s) 15 of the second end portion mouthpiece 13. Each aperture 15 of the second end portion mouthpiece 13 may have a perimeter equal to (where both ends have apertures that are the same) or less than about a third, more preferably less than about ¼, of the perimeter of the aperture 15 of the first end portion mouthpiece 12. Each of the embodiments in FIGS. 1A, 1B provides its own sensory experience for the user who receives a novel burst of liquid to the palate created by the number, size, shape, or position of the single or multiple apertures 15 of the mouthpiece 12 and/or 13.

FIG. 1A shows the drinking straw device 10 in the form of a circular bracelet portion 17 (wrist or arm not shown) that is manufactured of a flexible of bendable material capable of being straightened sufficiently to be placed somewhat vertically in a drinking container. Since shapes and images create pleasurable perceptions through their association with past experiences or known connotations, FIG. 1A is a bracelet that can be flexed into the shape of a heart. FIG. 1A also uses the image of a heart as the shape of the aperture 15 of the first end portion mouthpiece 12, that carries through the internal shape of the bore 16 of the drinking straw device 10, to the single aperture 15 of the second end portion mouthpiece 13 of the drinking straw device 10, creating a visual experience that directly influences the intensity of the sensory perception or excitement in the drinking experience because of its association with a widely-accepted pleasurable image. FIG. 1A, then, uses the internal shape of the bore 16 of the drinking straw device 10 that is carried through to both end portions of the straw mouthpieces 12, 13, to create a unique visual experience that directly influences the sensory perception or excitement in the drinking experience because of the user's association of the shape with pleasurable connotations or experiences. The bracelet portion 17 of FIG. 1A also has a flow regulator 14 that can be manipulated by the user or not. The flow regulator 14 is attached to the shaft 11 slightly below the second end portion mouthpiece 13, is circular in shape, and is wider in circumference than the shaft 11. It is constructed preferably of the same material, and fully encircles the drinking straw device 10. The flow regulator 14 of FIG. 1A allows the user, at the user's own discretion, to modify the flow of liquid from the point on the shaft where it is located to the second end portion mouthpiece 13 and its aperture 15. In its full open position, the flow regulator 14 allows liquid to flow unimpeded from the single aperture 15 of the first end portion mouthpiece 12, through the bore 16, to the second end portion mouthpiece 13 and its single aperture 15. As the user manipulates the flow regulator 14 to the desired sensation or intensity, the flow of liquid to the second end portion mouthpiece 13 and its aperture 15 is modified to the user's preference. To continue the heart-theme, the color of the bracelet of FIG. 1A, preferably is red, where it is at least partially a confection or where it is a child's apparatus. Such coloration would further enhance the pleasurable association when the color and shape of the bore 16 of the device are in harmony.

FIG. 1B shows a bracelet portion 17 that is partially edible. The first end portion mouthpiece 12 has a single, circular aperture 15 whose shape is carried through the bore, up to the slightly enlarged second end portion mouthpiece 13. In FIG. 1B, the second end portion mouthpiece 13 is made of a confectionery material, and has at its apex a single aperture 15 in the shape of a 5-point star. The remainder of the drinking straw device 10 is inedible, including the integral, removably attached drinking straw cap regulator 18 of FIG. 1B. Continuing with the description of FIG. 1B, along the shaft 11, but slightly below the second end portion mouthpiece 13 is a fixed lip rest 21, that prevents the drinking straw cap regulator 18 from coming off the end of the second end portion mouthpiece 13 after it has dissolved. Below the lip rest 21 can be seen in FIG. 1B the removably attached drinking straw cap extension ring 23 that has a cap portion extension 22 that connects the drinking straw cap regulator 18 to the shaft 11; the cap portion extension 22 has at one end the drinking straw cap regulator 18 and at the other end the cap portion extension ring 23 that encircles the shaft 11 of the drinking straw device 10. The cap portion ring 23 encircles the shaft 11 below the integrally constructed, fixed lip rest 21. Furthermore, the lip rest 21 of FIG. 1B is constructed such that the cap portion base 24 of the drinking straw cap regulator 18 snaps securely onto the lip rest 21, fitting snugly over the second end portion mouthpiece 13. When the second end portion mouthpiece 13 is fully covered by the drinking straw cap regulator 18, the user experiences the uniquely different sensation produced by the four apertures 19 of the drinking straw cap regulator 18. Alternatively, the drinking straw cap regulator 18 may be constructed without drinking straw cap regulator apertures 19. Without drinking straw cap apertures 19, the drinking straw cap regulator 18 completely encases the second end portion mouthpiece 13, preventing the flow of liquid to the user's mouth and serving to protect and keep the second end portion mouthpiece 13 clean when not in use. Continuing with the description of FIG. 1B, however, the drinking straw device 10 is a bracelet where the second end portion mouthpiece 13 is made of a confectionery material. However when the second end portion mouthpiece 13 of FIG. 1B is a confection, and after it is dissolved in the mouth of the user, the user would simply place the inedible drinking straw cap regulator 18 with multiple apertures 19 onto the shaft 11 and continue to use the drinking straw device 10, by sipping through the mouthpiece of the drinking straw cap regulator 18 and its apertures 19. In this embodiment, the drinking straw cap regulator 18 is a "supplemental" or substitute second end portion mouthpiece. When the "supplemental" or drinking straw cap regulator 18 is in use, the suctioned flow of liquid up through the aperture 15 of the single first end portion mouthpiece 12, the centrally-positioned bore 16, and the aperture 15 of the second end portion mouthpiece 13, the four apertures 19 of the drinking straw cap regulator 18 form four streams of the liquid that pass through the identically-shaped and -sized apertures 19, the novelty, then, of the burst of the liquid streams being created by the number, shape, size, and placement of the apertures 19 of the drinking straw cap regulator 18. With either embodiment (partially edible or inedible), however, the drinking straw device 10 may be separated for cleaning by the user. The user simply holds the drinking straw device 10 with one hand and with the second hand disengages or unsnaps the drinking straw cap regulator 18 from the lip rest 21. While holding the device, the user slowly moves the unitary drinking straw cap regulator 18, cap portion extension 22, and cap portion extension ring 23 down the shaft until the drinking straw cap regulator 18, cap portion extension 22, and cap portion ring 23, can be removed from the opposite end of the straw and its first end portion mouthpiece 12.

Figure 2B:
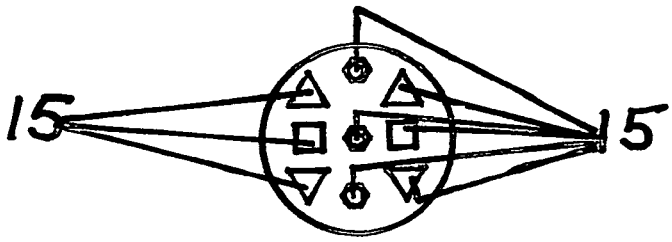
FIG. 2B is a cross-section of a drinking straw device according to FIG. 2A of the present invention, as shown from A-B.
Figure 2A:
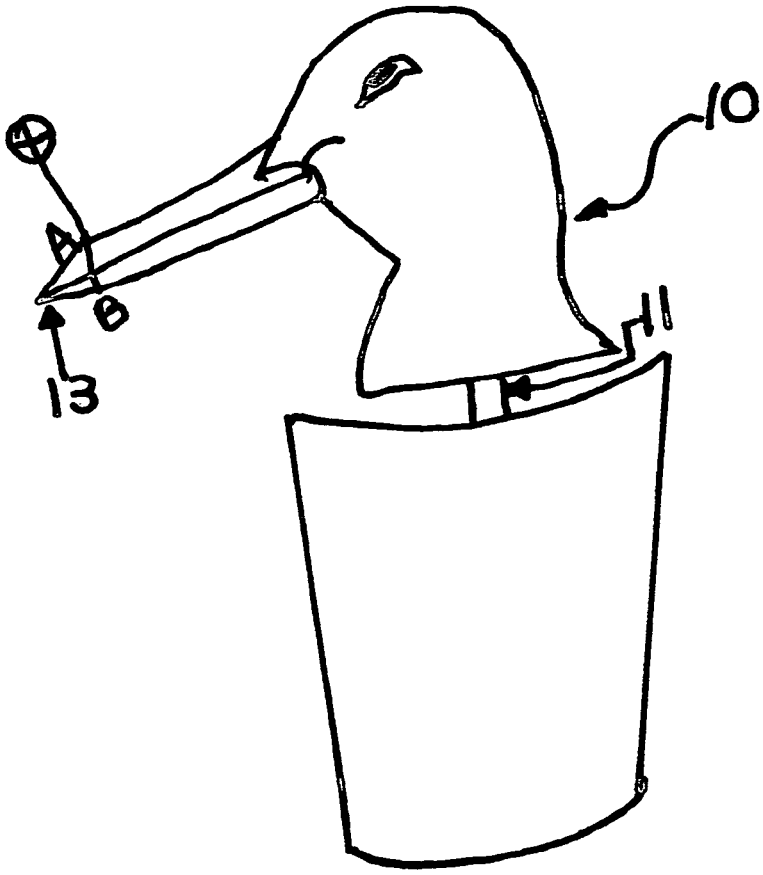
FIG. 2A is a perspective view of a drinking straw device according to the present invention.
Figure 2D:
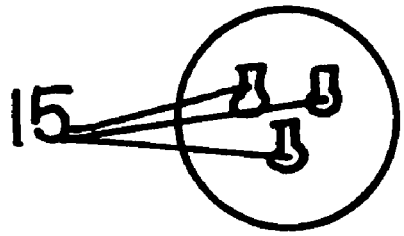
FIG. 2D is a cross-section of a drinking straw device according to FIG. 2C, as shown from A-B.
Figure 2C:
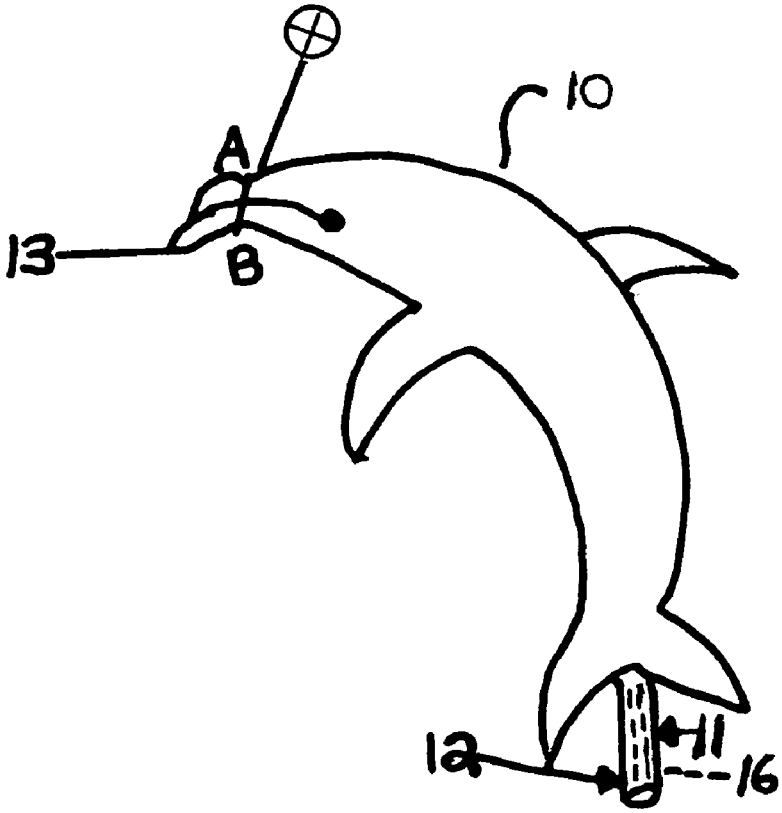
FIG. 2C is a perspective view of a drinking straw device according to the present invention.

In other embodiments of the current straw device, it can be readily seen that the drinking straw device 10 of FIGS. 2A-2D show images of a bird and an aquatic animal. In FIGS. 2A-2D, the second end portion mouthpiece 13 has a plurality of apertures 15, but the apertures 15 are in different shapes and sizes (FIG. 2A), and are in the same shape and size (FIG. 2C). The second end portion mouthpiece 13 of FIGS. 2A and 2C are placed somewhat symmetrically on a planar surface of the second end portion mouthpiece 13. When the drinking straw device 10 is in use, the user places the first end portion mouthpiece 12 into the beverage within a drinking container. The beverage comes into direct fluid communication with an interior of the bore as it flows to the second end portion mouthpiece 13 prior to coming into direct fluid communication with the user's mouth. The apertures 15 are distributed across a surface of the second end portion mouthpiece 13 as seen in the figures.

Looking specifically at FIG. 2A, the drinking straw device 10 is in the form of a wading or shore bird with a slightly open beak. The shape of the shore bird is integrally formed by molding the bird's shape around the exterior surface of the straw's shaft 11. In FIG. 2A, only the head of the shore bird (with the second end portion mouthpiece 13) is shown. For use, the first end portion mouthpiece 12 (not shown) of FIG. 2A is placed into the beverage container. In FIG. 2A, the second end portion mouthpiece 13 extends from the tip of the beak to the area marked by the intersection of a slightly vertical line with the horizontal line of the beak. FIG. 2A shows at the slightly vertical line a flow regulator (marked by the valve symbol).

FIG. 2B is a close-up, cross-section of the multiple apertures 15 of the second end portion mouthpiece 13 from A-B of FIG. 2A, through which the liquid flows to the mouth of the user in unique multiple sprays as desired or selected by the user. In its full open position, the valve (shown in FIG. 2A) allows the liquid flow to move unimpeded through several different shapes (triangles, arrowheads, hexagon, squares) prior to reaching the user's mouth. When in use, the suctioned flow of the liquid moves up through the aperture 15 of the single first end portion mouthpiece 12, through the bore 16, through the apertures 15 of the second end portion mouthpiece 13, creating a plurality of different streams of liquid passing through the different apertures.

The current invention can be in the shape of any animal—fish or mammal, including cetaceous aquatic mammals. Moving to the embodiment of FIG. 2C, the drinking straw device 10 is in the shape of an aquatic mammal known as the bottled-nosed dolphin or porpoise. In FIG. 2C, the entire shape of the bottle-nosed dolphin is shown, and is molded around the exterior of the shaft 11 of the drinking straw device 10. The first end portion mouthpiece 12 is at the end of the shaft 11 that is inserted into the liquid of the beverage container (not shown). In FIG. 2C, the second end portion mouthpiece 13 extends from the tip of the mouth of the dolphin to the point marked by the intersection of the somewhat vertical line with the horizontal line of the mouth. FIG. 2C has, behind the vertical line of the mouthpiece, a flow regulator (marked by the valve symbol). In its open position, the regulator, through the mouth of the dolphin, allows the liquid to flow to the mouth of the user in unique, multiple sprays as desired or selected by the user. In its fully closed position, the regulator prevents the flow of liquid from the bore to the mouthpiece and the mouth of the user.

FIG. 2D is a close-up, cross-sectional view of the multiple apertures 15 of the second end portion mouthpiece 13 from A-B of FIG. 2C. Specifically, FIG. 2D shows three apertures 15 in the shape of bottles that are of the same size. From the apertures 15, the liquid flows to the mouth in unique, multiple sprays as desired or selected by the user using the regulator. In its full open position, the regulator allows the liquid flow to move unimpeded through the three bottle-shaped apertures 15 prior to reaching the user's mouth. In its fully closed position, no liquid flows through the apertures 15 to the user's mouth. As with all embodiments of the current invention, the apertures 15 are in direct fluid communication with the bore 16 and the first end portion mouthpiece 12 when the straw device 10 is in use. Also when in use, the second end portion mouthpiece 13 is in direct communication with the aperture 15 of the first end portion mouthpiece 12, so that a suctioned flow of the stream of liquid up and through the aperture 15 of the first end portion mouthpiece 12, through the bore 16, to the three apertures 15 of the second end portion mouthpiece 13, forms three streams of the liquid that passes out of the three second end portion apertures 15, creating a novel burst of three liquid streams to the palate of the user. The number, positions (strategic or random placement), size, or shape of the apertures 15 of the second end portion mouthpiece 13 may vary in other embodiments of the present invention, such as FIGS. 1A, 1B, 2A, 2C, 3, 4C, 5A-D, 6A-B, 7A-B, 8, and 9A and 9B.

Figure 3:
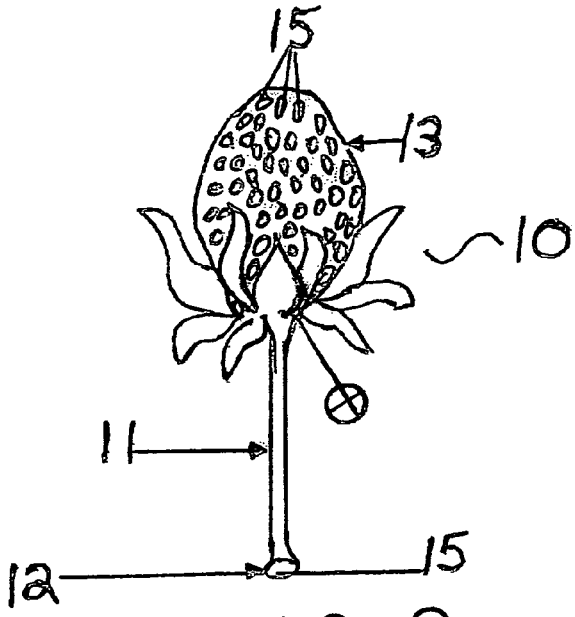
FIG. 3 is a perspective view of a drinking straw device according to the present invention.
Figure 4A:
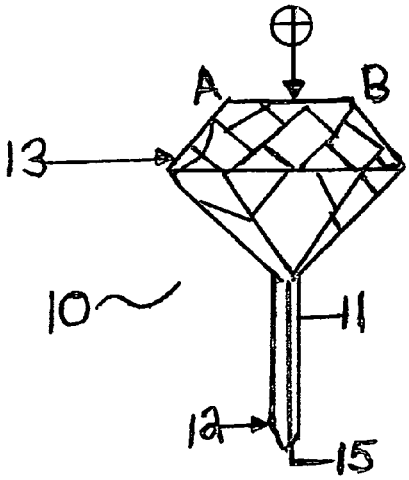
FIG. 4A is a perspective view of a drinking straw device according to the present invention.
Figure 4C:
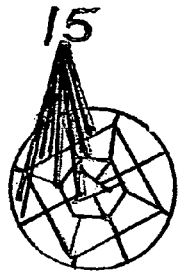
FIG. 4C is a cross-section of a drinking straw device according to the present invention, as shown from A-B of FIGS. 4A and 4B.

Referring to FIGS. 3 through 4C, the drinking straw device 10 may be in the form pr likeness of any plant or mineral. The drinking straw device 10 of FIG. 3 is constructed partially as a confection, where the confectionery portion is a candy in the shape of a strawberry with multiple apertures. Looking specifically at FIG. 3, there is a single aperture 15 on the first end portion mouthpiece 12. Along the upper portion of the shaft of FIG. 3 there can be seen leaves, within which is nestled the second end portion mouthpiece 13 that is a strawberry-flavored candy with multiple apertures 15—varyingly-placed and irregular-shaped. (NOTE: In FIG. 3, only the three apertures in the viewable area pointed to are usable; the balance in the viewable area are mock apertures and liquid cannot pass through them.) The drinking straw device 10 of FIG. 3 also can be made of an inedible material. As a partially edible confection, the fruit is confectionery, while the shaft and leaves are not. In other fruit confections, the shape of the drinking straw device 10 likewise would correspond to the flavor of the fruit. When in use, the liquid flowing from the container in which FIG. 3 sits, moves up, in direct, fluid communication from the single aperture 15 of the first end portion mouthpiece 12, through the centrally-placed bore 16 (not shown), out through the multiple apertures 15 of the second end portion mouthpiece 13, creating a plurality of different streams of the candy-flavored liquid that passes through the different apertures of the second end portion mouthpiece.

Figure 4B:
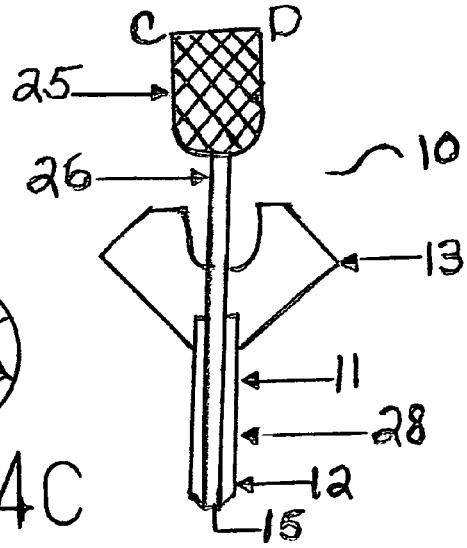
FIG. 4B is a longitudinal section of FIG. 4A according to the present invention.

Referring to FIGS. 4A-C, a drinking straw device 10 of the current invention may be in the shape of little- or well-known minerals. FIG. 4A is a drinking straw device 10 with one of its mouthpieces in the shape of a brilliant-cut diamond. Specifically, opposite the first end portion mouthpiece 12 (which is multi-sided) is a diamond shaped, second end portion mouthpiece 13. The diamond shape is molded around an exterior of the shaft 11 of the drinking straw device 10. The first end portion mouthpiece 12 of FIG. 4A has a single aperture 15 connecting to a bore 16, while the second end portion mouthpiece 13 of FIG. 4A has multiple apertures 15. The apertures 15 of the second end mouthpiece 13 are in direct, fluid communication with the bore 16, so that when the straw device of 4A is in use, the beverage flows from the first end portion mouthpiece 12, up and through the bore 16 (not shown) of the shaft 11, to and through the apertures 15 of the second end portion mouthpiece 13 to the mouth of the user, creating a novel burst of liquid sensation to the palate of the user. The shaft 11 and the diamond-shaped second end portion mouthpiece 13 may be made of the same material, or may be made of different materials. For instance, the entire drinking straw of FIG. 4A may be made entirely of glass or entirely of a suitable clear plastic material capable of giving an appearance of refractory light. Alternatively, the first end portion mouthpiece 12 and the shaft 11 may be made of a corrosive-resistant metal such as stainless steel or silver, while the second end portion mouthpiece 13 may be made of glass or a suitable plastic.

FIG. 4B is an embodiment of FIG. 4A of the current invention. It permits an even greater variation in the shape of mouthpieces and the sensation created by the shape and size of the mouthpieces. Pictured in FIG. 4B is a first end portion mouthpiece 12 with a single aperture 15 connected directly to the bore 16 (not shown) of the drinking straw device 10. The bore extends, through the second end portion mouthpiece 13, which is shaped like a brilliant-cut diamond (Refer to FIG. 4A), to a smaller mouthpiece portion 25 (a briolette-cut diamond) molded around the shaft 11. The shaft 11 that connects to the second end portion mouthpiece 13 of FIG. 4B has a lower, extended shaft portion 26 that is extendable and retractable from the second end portion mouthpiece 13 and molded to the smaller mouthpiece portion, effectively extending the mouthpiece in a manner that would be more comfortable to the user. To access the smaller mouthpiece portion 25 of FIG. 4B, the user would grasp the shaft 11 with one hand while with the other hand, gently lift and turn the extended shaft portion 26 a quarter turn to lock the position of the extended shaft portion 26 and its smaller mouthpiece portion 25 in place. Alternatively, the locking mechanism can be in any form currently available in the marketplace. However, FIG. 4A shows the shaft 11 encased within a sheath, manufactured of the same material as the shaft, that contains at its upper terminus indicia for engaging and disengaging the shaft 11 in its extended position. Alternatively, the shaft 11, itself, may be constructed with indicia directly on the shaft 11 to lower a smaller shaft portion into a larger shaft portion when the smaller mouthpiece portion is not in use. FIG. 4B may be used with the smaller mouthpiece portion 25 and the extended shaft portion 26 in their extended position, but at the user's preference.

FIG. 4C is a cross-section of the top surface of FIGS. 4A from A-B, and FIG. 4B from C to D. FIG. 4C is the uppermost portion of the second end portion mouthpiece 13 of FIGS. 4A and 4B which has multiple apertures 15 of different shapes and sizes, arrayed in an irregular (random) kaleidoscopic fashion. The apertures 15 of the second end portion mouthpiece 13 are in direct, fluid communication with the centrally-placed bore 16, so that when the straw device of 4A and of 4B are in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user. The sensation in the mouth of the user would vary, depending upon whether the smaller mouthpiece portion 25 is selected by the user for use.

Figure 5A:
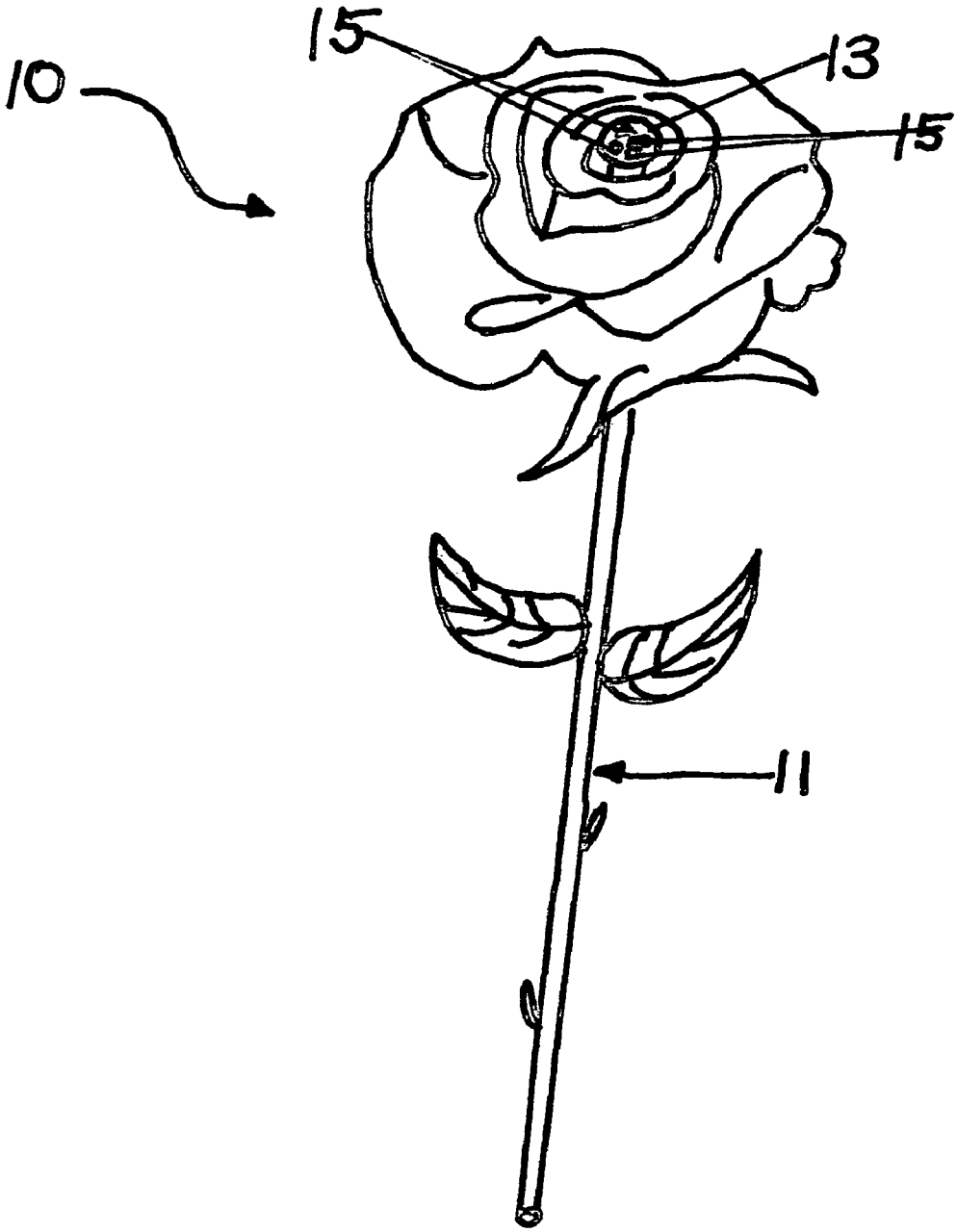
FIG. 5A is a perspective view of a drinking straw device according to the present invention.

FIGS. 5A-5D are the current invention in the shape of plants, specifically flowers. Any number of flowers would be suitable, such as the camellia, carnation, peony, bellflower, rose, rose of sharon, scabiosa, lollipop helenium, daisy, cone flower, black-eyed susan, aster, sunflower, day lily, daffodil, crocus, tulip, and many others. Suitable vegetable plants might be, e.g., eggplant, broccoli, cauliflower, carrots, and celery. FIG. 5A, specifically consists of a rose with thorns and leaves molded around the shaft 11 of the drinking straw device 10. The shaft 11 represents the stem of the flower. The second end portion mouthpiece 13 of FIG. 5A is located in the top center portion of the rose. Included on the second end portion mouthpiece 13 are four apertures 15 in different shapes and sizes. FIG. 5A preferably is manufactured of a suitable plastic material that is capable of being molded to shape around the shaft 11. Preferably, the aroma of the flower can be infused within the material, giving the drinking straw an even closer association with the flower. The apertures 15 of the second end mouthpiece 13 are in direct, fluid communication with the bore 16 (not shown), so that when the straw device of 4A is in use, the beverage flows from the first end portion mouthpiece 12, up and through the bore 16 of the shaft 11, to and through the apertures 15 of the second end portion mouthpiece 13 to the mouth of the user, creating novel burst of liquid sensation to the palate of the user.

Figure 5B:
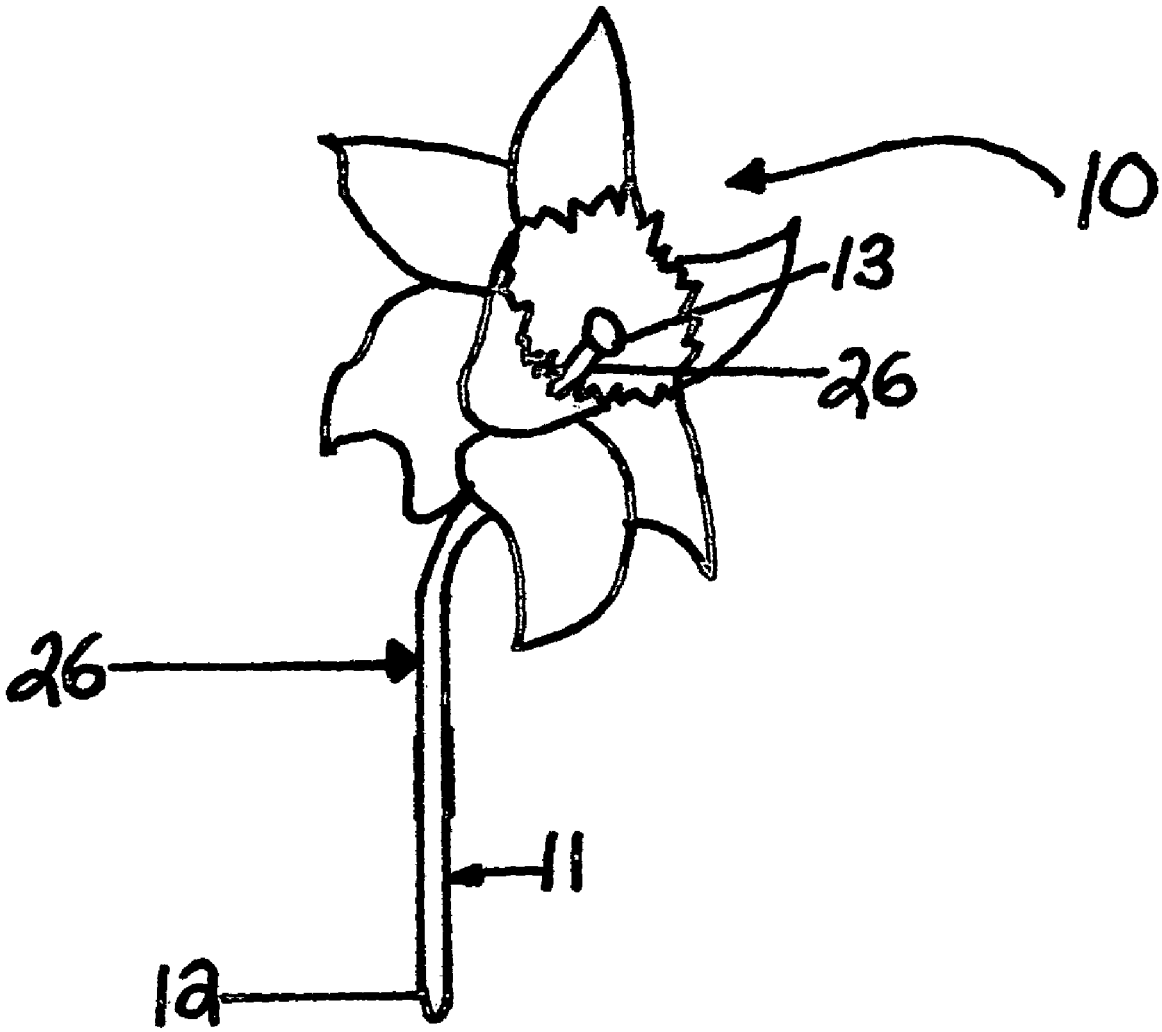
FIG. 5B is a perspective view of a drinking straw device according to the present invention.

FIG. 5B is the drinking straw device 10 manufactured in the shape of a daffodil. The flower is molded around the shaft 11 which represents the stem of the flower, and which has an extended shaft portion 26 that morphs into a representation of the filament of the flower. At the end of the shaft 11 which is opposite the first end portion mouthpiece 12, the shaft 11 (filament) becomes part of the second end portion mouthpiece 13 that appears in FIG. 5B as the anther of the flower. The shaft 11 of FIG. 5B is extendable and retractable. As seen in FIG. 5B, the extended shaft portion 26 allows the stem to be longer or shorter, at the user's discretion for a larger or smaller container. The shaft 11 of FIG. 5B is constructed with indicia to allow the shaft portion with a smaller diameter to nest into the larger shaft portion when the extended shaft portion 26 is not in use.

Figure 5C:
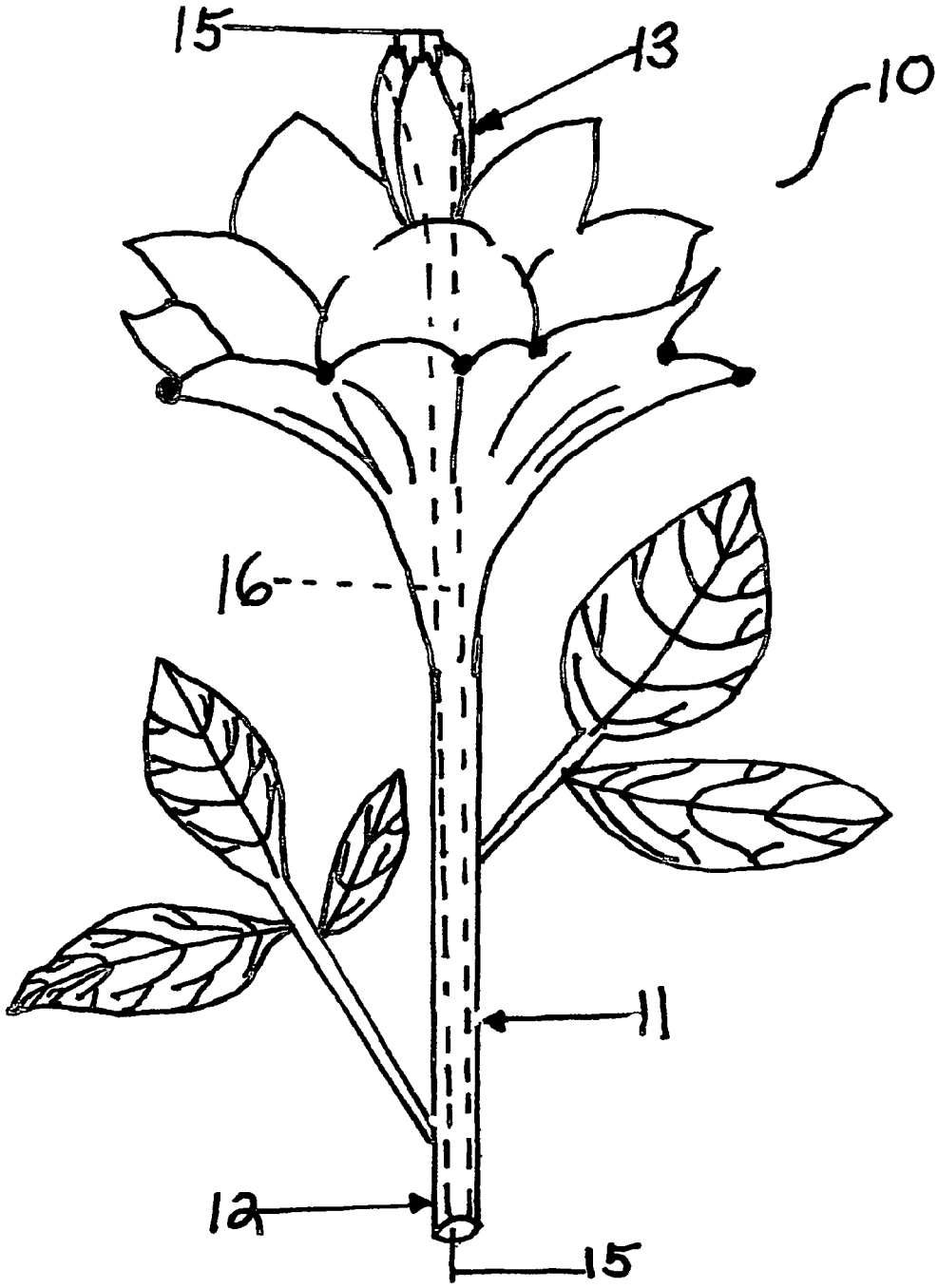
FIG. 5C is a perspective view of a drinking straw device according to the present invention.

FIG. 5C is the drinking straw in the shape of a hydrangea. In FIG. 5C, the second end portion mouthpiece 13 consists of four apertures 15 of the same shape and different sizes, and in different positions on the flower head. Also in FIG. 5C the flower had is directly opposite the first end portion mouthpiece 12 with its single aperture 15. The second end portion mouthpiece 13 is made of the four "pedals" that can be seen at the top most portion of the flower head. The shaft 11 of FIG. 5C is the flower stalk, while the stems of the two compound leaves that are attached to the flower stalk are molded to the stem shaft 11. The stem shaft 11 extends vertically and uninterrupted from the single aperture 15 of the first end portion mouthpiece 12 to the four apertures 11 of the second end portion mouthpiece 13. Conversely also, in FIG. 5C, the apertures 15 of the second end portion mouthpiece 13 are in direct, fluid communication with the bore 16 and the apertures 15 of the first end portion mouthpiece 12, so that when the straw device of 5C is in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user.

Figure 5D:
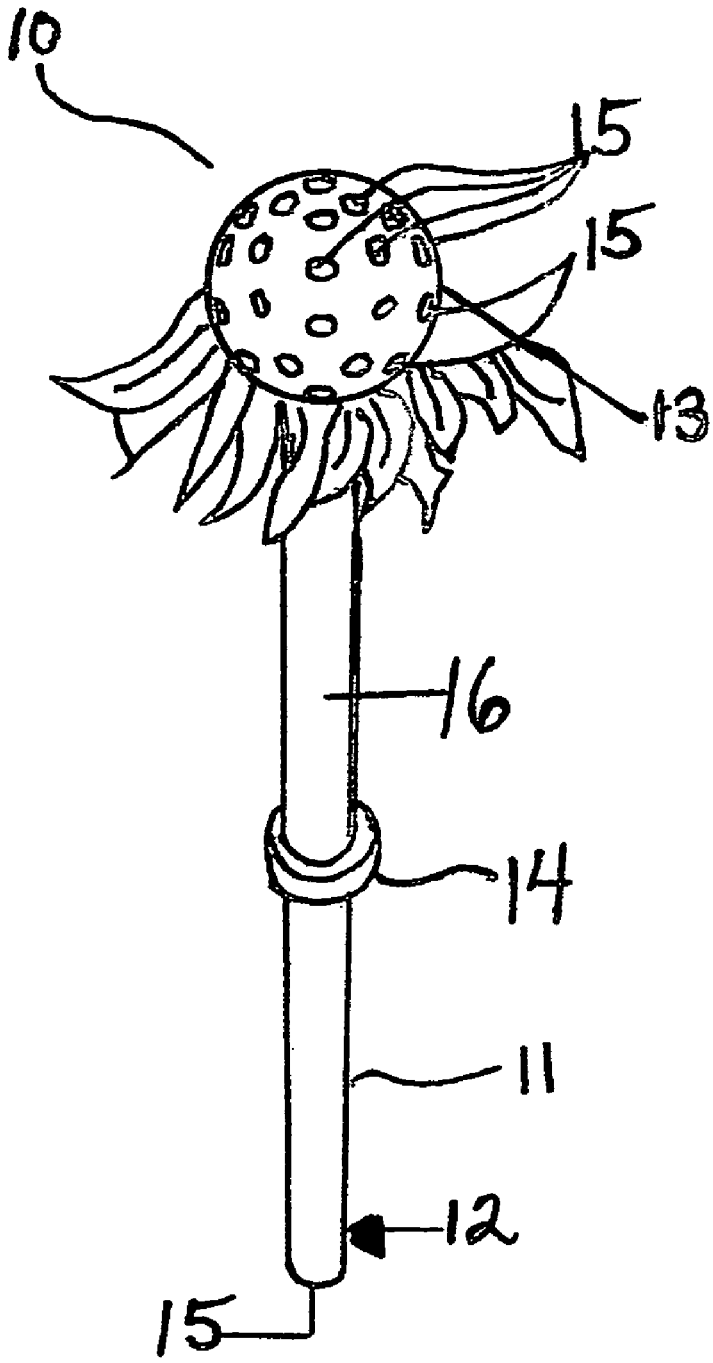
FIG. 5D is a perspective view of a drinking straw device according to the present invention.

Referring to FIG. 5D, the drinking straw device 10 is in the form of a coneflower. The drinking straw device 10 includes a first end portion mouthpiece 12 (with a single aperture 15) connecting to a bore 16 that is encased within the shaft 11 that represents the flower stalk of the drinking straw device 10. The diameter of the shaft 11 is smaller at the first end portion mouthpiece 12 and gradually increases in diameter as it reaches the second end portion mouthpiece 13. The second end portion mouthpiece 13 has multiple apertures 15 that are in the shape of circles, ovals, and ellipses. Interior to the shaft, the bore connects directly to the second end portion mouthpiece 13 and its multiple apertures 15. Molded to the exterior of the second end portion aperture are leaves typical of this flower type, such as daisies, sunflowers, and black-eyed susans. The drinking straw device of FIG. 5D is made of plastic, but can be made in any suitable, reusable material. When the straw device of 5D is in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user. It can be seen in FIG. 5D that the shaft 11 has a removably attached, fully external flow regulator 14 (also made of plastic) that encircles the shaft 11 near its mid-section. To use the regulator 14, the user slides the regulator 14 up the shaft 11 until the desired sensation is reached. At its highest point on the shaft 11, the regulator 14 closes off the flow of liquid completely from the bore 16 to the second end portion mouthpiece 13.

Figures 6A, 6B:
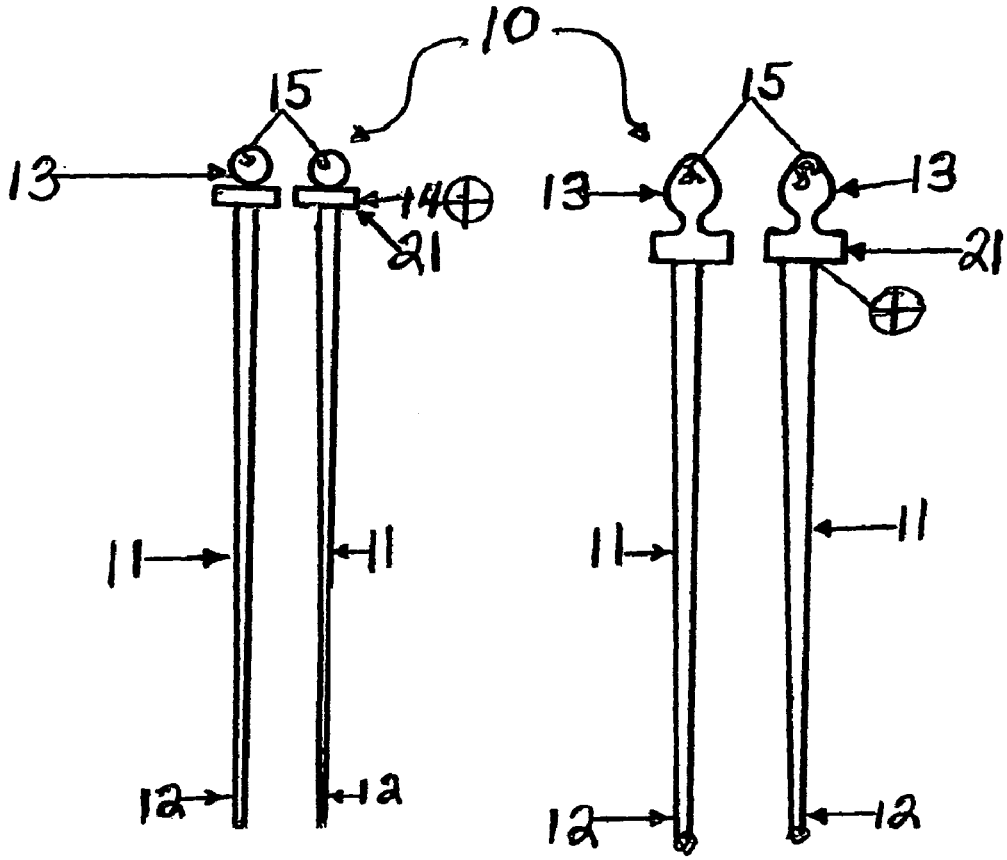
FIG. 6A is a perspective view of a drinking straw device according to the present invention.
FIG. 6B is a perspective view of a drinking straw device according to the present invention.

Referring to FIGS. 6A and 6B, the drinking straw device 10 is in the form of 2 pairs of chopsticks. As a principal eating utensil, the drinking straw device 10 as chopsticks have the added functionality where both solid and liquid contents may be enjoyed using one standard utensil. While FIGS. 6A and 6B are different embodiments, they represent the same concept. When the straw device of FIGS. 6A and 6B are in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user. Looking at FIG. 6A, the chopsticks have a single, circular aperture 15 at the first end portion mouthpiece 12, as well as a single aperture 15 in a scroll-like configuration on the second end, portion mouthpiece 13. Also in FIG. 6A, a flow regulator 14 sits at the base of the second end portion mouthpiece 13 and serves as the lip rest 21. To use the regulator, the user turns the external portion of the regulator (the lip rest 13) to the desired or selected sensation. Moving to FIG. 6B, there also is a single aperture 15 at the first end portion mouthpiece 12, and a single aperture 15 at the second end portion mouthpiece 13. The single aperture 15 of the second end portion mouthpiece 13 of FIG. 6B, however, is in the form of the symbol for the current Chinese New Year. Continuing with the description of FIG. 6B, the user can further modify the flow of liquid to his or her mouth by rotating the entire second end portion mouthpiece 13, including the lip rest 21 with its internal regulator. Similar to FIG. 7B, as the user rotates the external portion of the regulator, the sensation of the aperture changes by redirecting the flow of liquid in the mouth of the user.

Figure 7A:
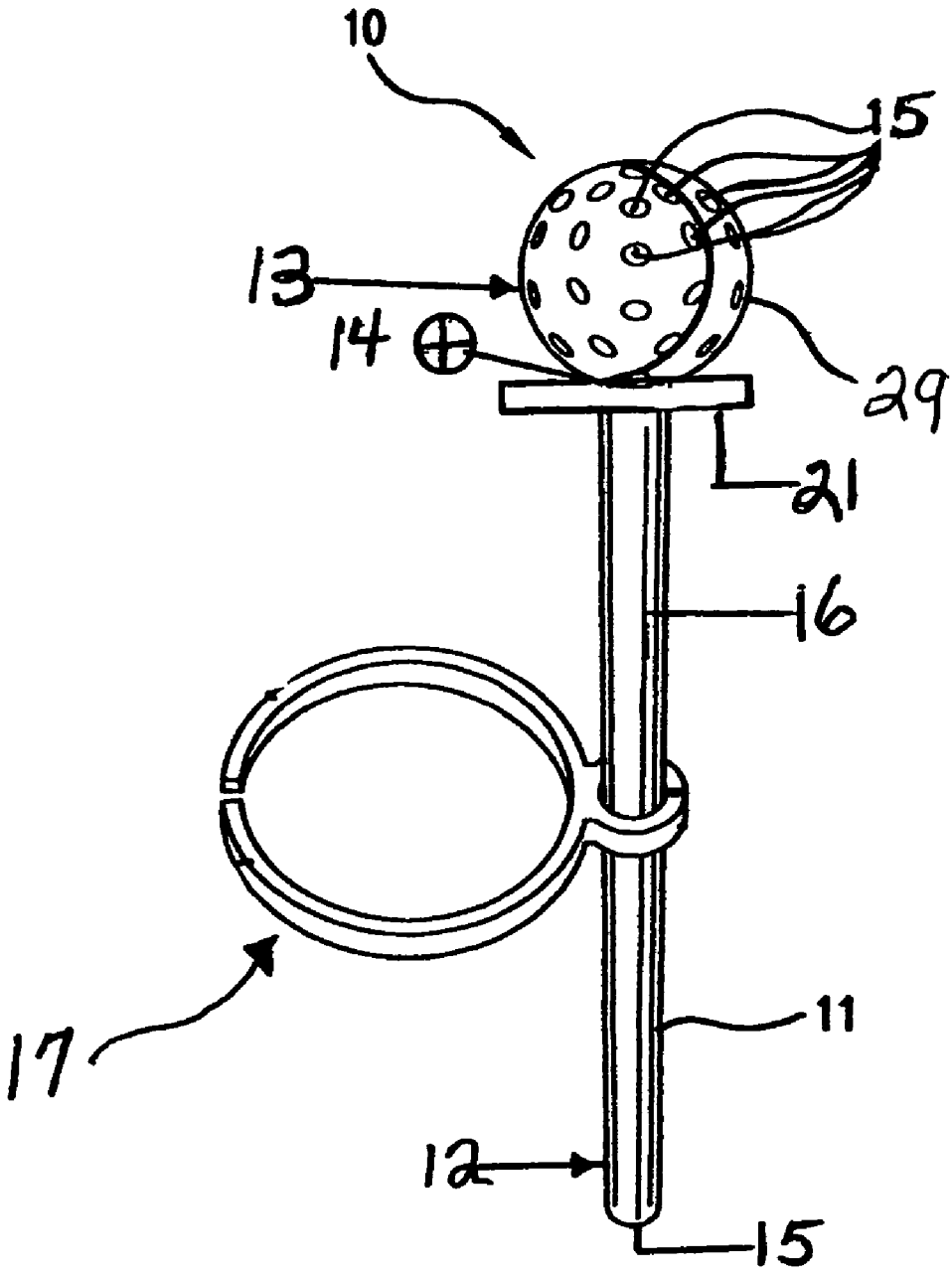
FIG. 7A is a cross-section of a drinking straw device according to the present invention.

Referring to FIG. 7A, the drinking straw device 10 consists of a bracelet portion 17 that clasps around the wrist or arm of the user. A smaller clasp encircles the drinking straw that has a single, circular aperture 15 on the first end portion mouthpiece 12, and multiple apertures 15 on the opposite end of the device at the second end portion mouthpiece 13. The flow regulator 14 acts as a lip rest 21 and sits at the base of the second end portion mouthpiece 13. The regulator of FIG. 7A, however, includes an external component that rotates an internal arm 29 that allows the unimpeded flow of liquid through the apertures 15 or closes off the flow of liquid from multiple apertures, depending upon the user's preference. As the user turns the external portion of the regulator 14, the internal rotating, arm 29 constructed along an internal wall of the second end portion mouthpiece 13, covers the apertures—selectively prohibiting liquid to flow through the covered apertures 15, according to the user's preference. In FIG. 7A, it can be seen that a total of 5 apertures have been covered and, therefore, closed off by the internally rotating arm 29. When the straw device of 7A is in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user. The user, at his or her discretion, is able to further modify the sensation from FIG. 7A by use of the regulator 14 and its internal rotating arm 29.

Figure 7B:
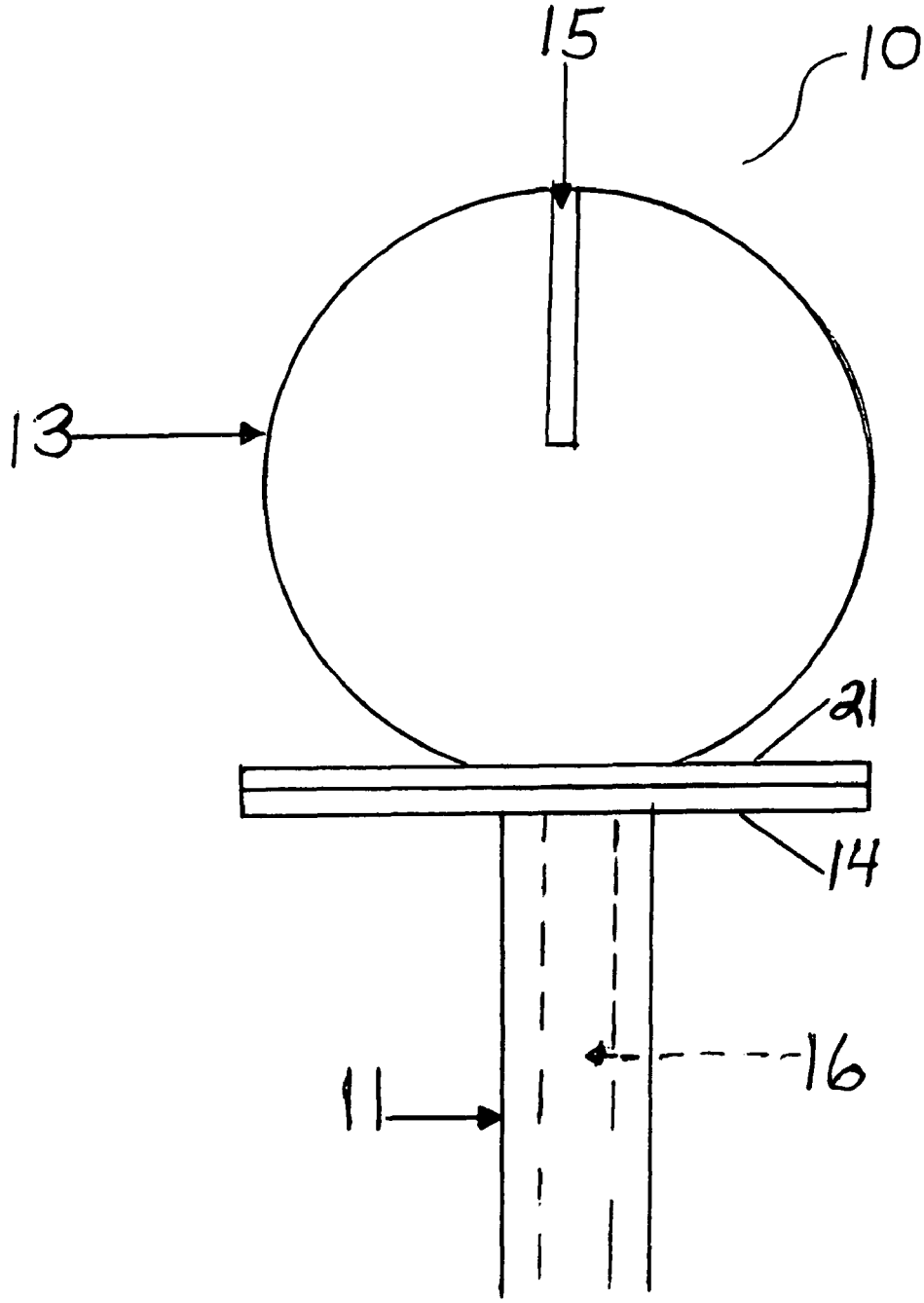
FIG. 7B is a perspective view of a drinking straw device according to the present invention.

FIG. 7B is a perspective view of the alternative embodiment of the second end portion mouthpiece 13 of FIG. 7A. The alternative embodiment of the second end portion aperture 13 is similar in effect to FIG. 6B. However, in this figure, the single aperture 15 of the second end portion mouthpiece 13 is a single, narrow rectangle that runs symmetrically from one side of the circular second end portion mouthpiece 13, across the apex, to the opposite side of the mouthpiece. In FIG. 7B, when the user rotates the exterior of the regulator 14, the second end portion mouthpiece 13 revolves. In revolving, the liquid from the narrow, rectangular aperture is directed to a different part of the mouth, creating a novel burst of liquid at the desired location in the mouth or with the desired sensation or preference of the user. As with all other embodiments of the drinking straw device 10, when the straw device of 7B is in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate-of the user. The user, at his or her discretion, is able to further modify the sensation from FIG. 7B by use of the regulator, and at the user's discretion.

Figure 8:
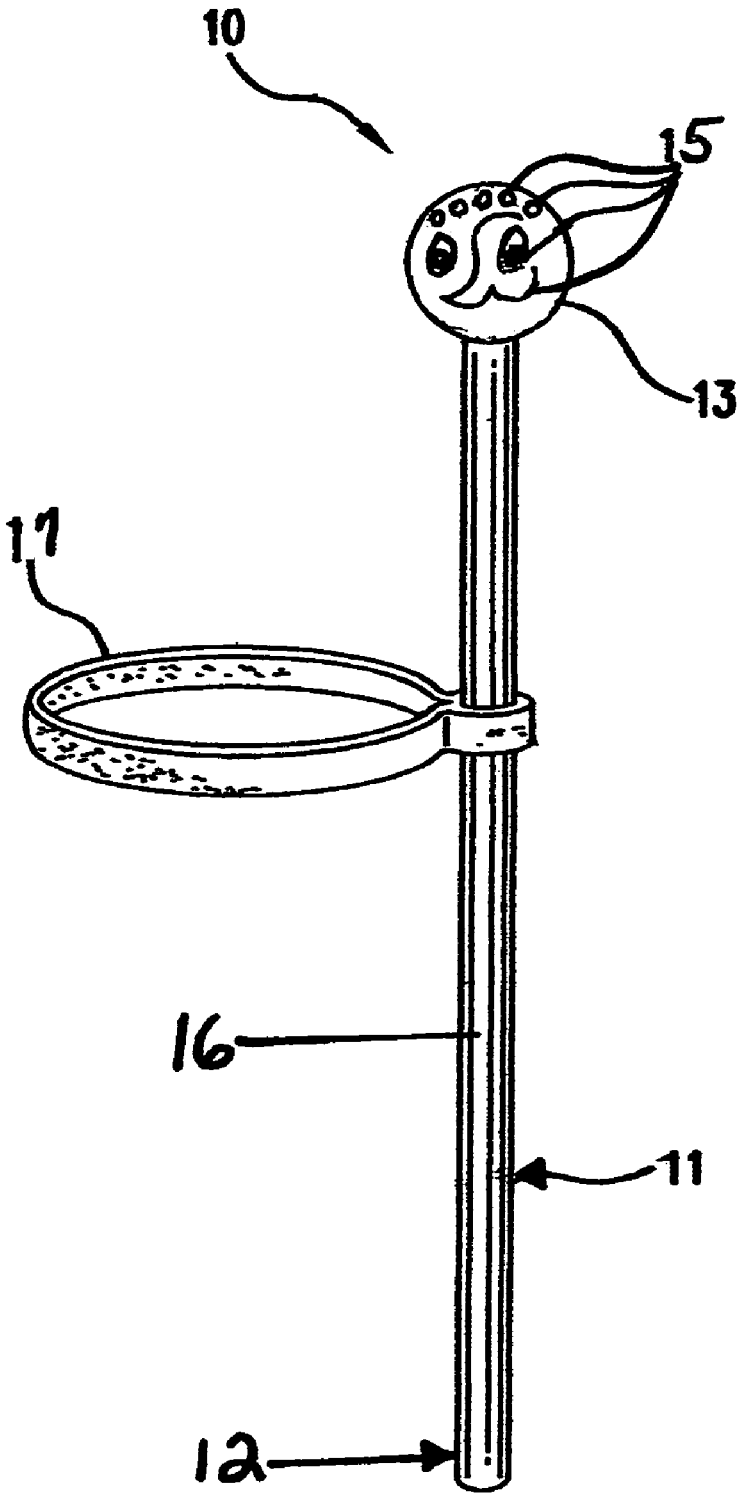
FIG. 8 is a perspective view of a drinking straw device according to the present invention.

The drinking straw device 10 may be detachably attached to or in the form of a bracelet. The second end portion mouthpiece 13 of FIG. 8 is in the shape of a cartoon character or clown. The multiple apertures 15 of the second end portion mouthpiece 13 comprise the features of the clown, and have different shapes and different sizes and placement. The shapes of the apertures 15 are generally circular, oval, and scroll-like. When the straw device of FIG. 8 is in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user.

Figure 9A:
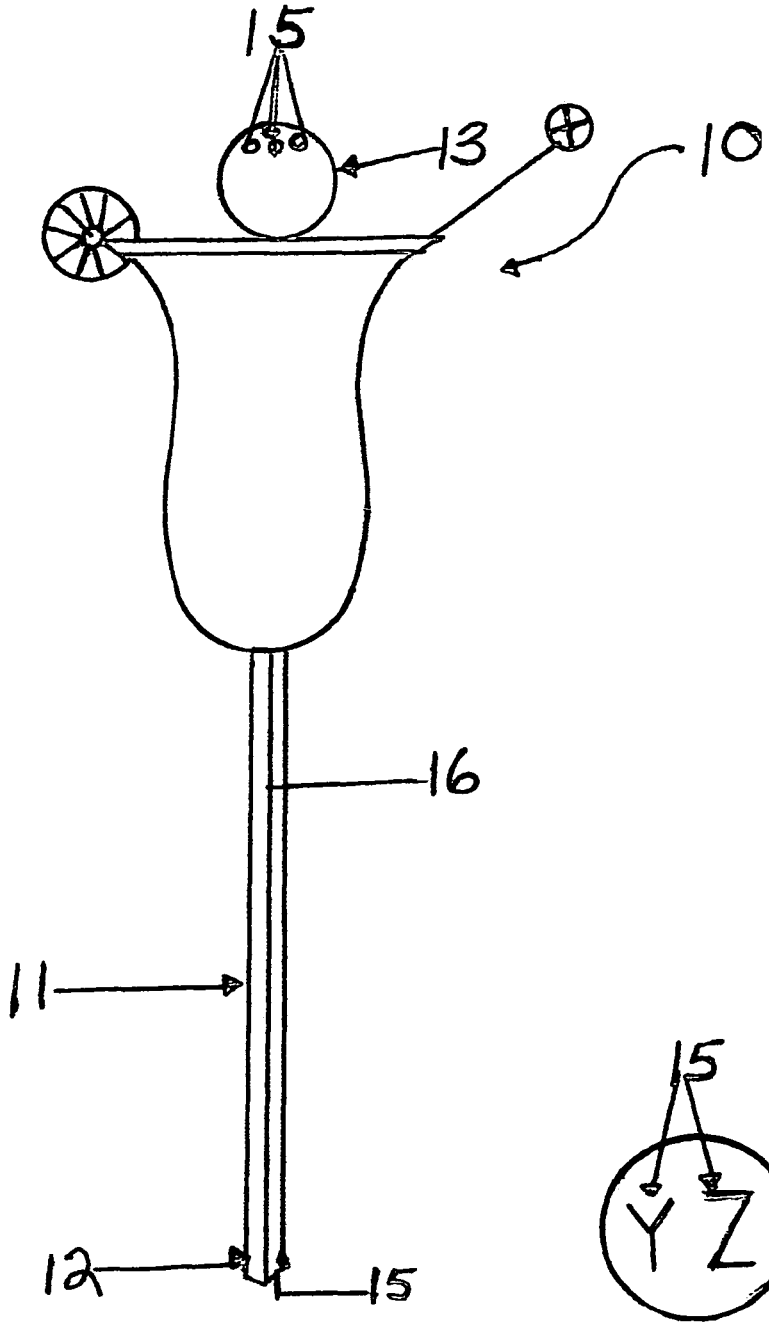
FIG. 9A is a perspective view of a drinking straw device according to the present invention.
Figure 9B:
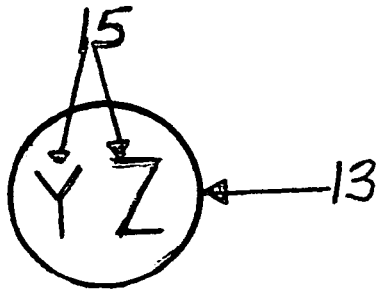
FIG. 9B is a cross-section of a drinking straw device according to the present invention, as shown from A-B of FIG. 9A.
Figure 9C:
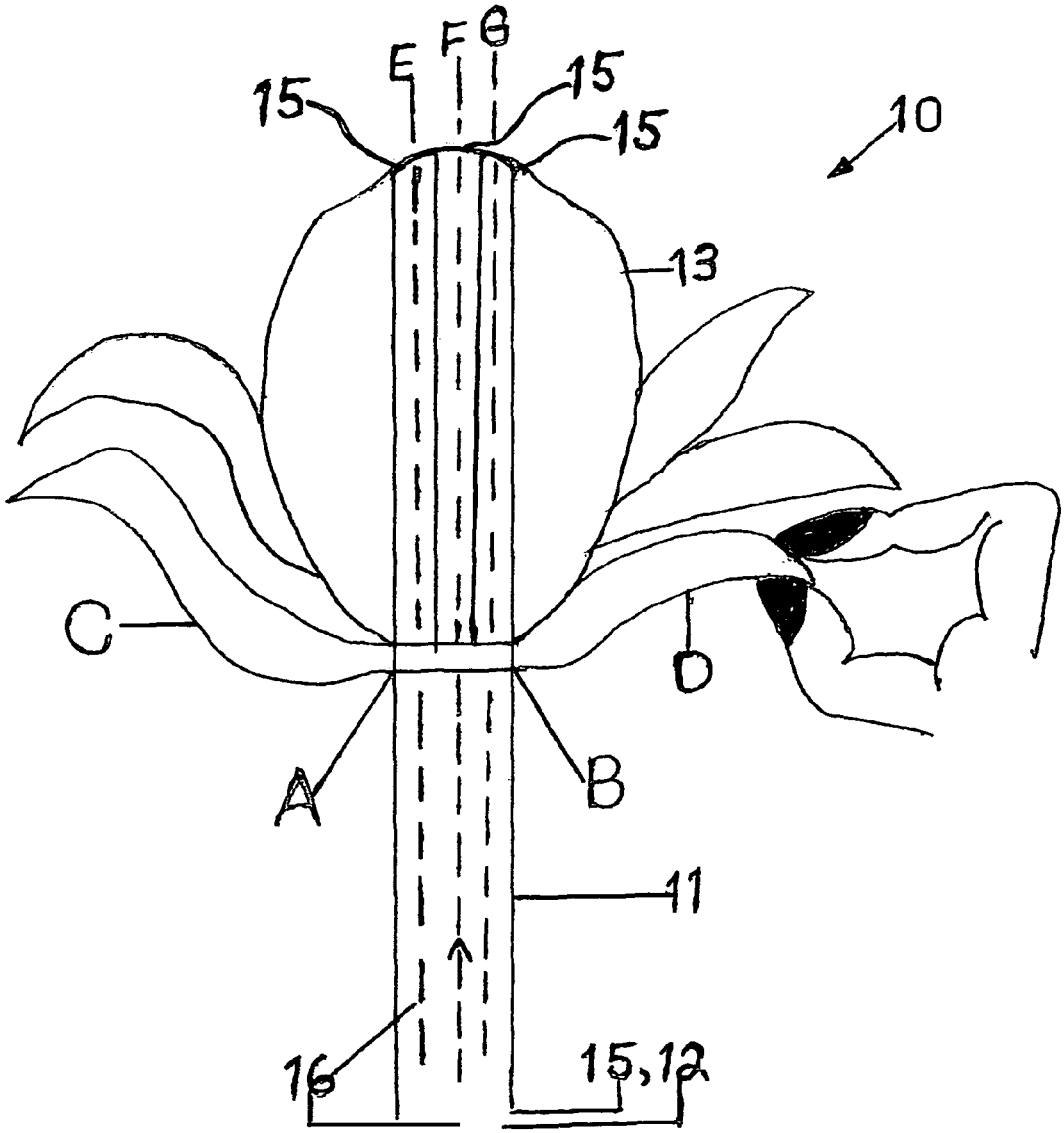
FIG. 9C is a longitudinal section of FIG. 3 according to the present invention.

The drinking straw device of the current invention can be in the shape or form of any object. Looking at FIG. 9A, the drinking straw device is in the embodiment of a common object—a cocktail glass of a tropical drink with a slice of lime on the side and a cherry perched on top. The lime is molded to the flow regulator which is capable of modifying the flow of liquid from the four apertures 15 of the second end portion mouthpiece 13. The apertures of FIG. 9A are circular, but may also be circular with spindles or spokes to imitate the form of the lime To ensure that the draw from the single aperture 15 of the first end portion mouthpiece 12 is maintained, the bore 16 extends vertically to the second end portion mouthpiece 13 and its apertures. The shape of the cocktail glass of FIG. 9A is molded around the shaft 11 and the bore 16. FIG. 9B is an alternative embodiment of FIG. 9A, but with a cross-section of the second end portion mouthpiece 13, where the apertures are in the form of two alphabets symbolizing the monogram of the user, purchaser, or the establishment. By "symbolizing" is meant any depiction used to represent, typify or stand for a user, purchaser, or establishment, which in FIG. 9B is a monogram. As with all other embodiments of the drinking straw device 10, when the straw device of 9A or 9B is in use, the beverage flows from the first end portion mouthpiece 12, up and through the bore 16 of the shaft 11, to and through the apertures 15 of the second end portion mouthpiece 13 to the mouth of the user, creating a novel burst of liquid sensation to the palate of the user. At the user's discretion, the flow of liquid can be modified even further through the use of the flow regulator. For example, FIG. 9C is a longitudinal section of the device 10 of the current invention that is in the form of a strawberry plant, similar to that shown in FIG. 3. FIG. 9C shows the device 10 being manipulated by a user's two fingers and is an example of how the device 10 is configured to create a variation in sensation or direction of the liquid flow. In this embodiment, the internal portion of the flow regulator is marked from A-B. As can be seen also in FIG. 9C, the internal portion A-B of the regulator is housed in the shaft 11 of the straw 10 and is located strategically between a single and three hollow bores 16. Also, as shown in FIG. 9C, the external portion of the regulator is in the form of two leaves or bracts C-D, placed opposite one another, and connected to the interior portion A -B. All other leaves/bracts on the device are for decoration only. As depicted in the drawing, the liquid flows up and through the first end portion mouthpiece 12 and continues through the regulator where, in the full open position of the regulator, the liquid separates into three distinct columns of liquid as depicted as E, F, and G. It can be seen that each of the three columns of liquid E, F, and G is separate from the other and is in fluid communication with the flow regulator at their base, and with each of three apertures 15 on the second end portion mouthpiece 13. The internal and external portions of the flow regulator of FIG. 9C—the two opposite leaves or bracts C, D, and A-B—are configured to rotate together, as one unit. As depicted in FIG. 9C, the regulator is configured so that the user can grasp the external portion of the regulator with two of his/her fingers (in this drawing the user is manipulating the device with the thumb and forefinger). The user, then, rotates laterally the external portion (leaf/bract C or D) of the flow regulator, thereby also rotating the internal portion A-B. While the interior portion of the flow regulator is rotating, it is configured to open or close all columns or portions of columns of liquid E, F, or G . Alternatively, the internal portion A-B of the regulator can have on its upper surface its own apertures of varying number, shapes, sizes, angles or placement. Such a variation could further alter the direction, location, intensity, or sensation of the columns of liquid E, F, and/or G to the mouth of the user.

From the foregoing it can be realized that the described device of the present invention may be easily and conveniently utilized as a drinking straw. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 drinking straw
11 shaft
12 first end portion mouthpiece
13 second end portion mouthpiece
14 flow regulator
15 aperture
16 bore
17 bracelet portion
18 drinking straw cap regulator
19 drinking straw cap aperture
21 lip rest
22 cap portion extension
23 cap portion extension ring
24 cap portion base
25 smaller mouthpiece portion
26 extended shaft portion
27 removable cap apertures
28 sheath
29 internal rotating arm

What is claimed is:

1. A freestanding drinking straw device comprising a first end portion mouthpiece, the first end portion mouthpiece comprising a single first end portion aperture connecting to a shaft consisting of a hollow bore, the straw device further comprising a second end portion mouthpiece connected to the opposite end of the shaft and the hollow bore, the bore in fluid communication with an adjustable fluid regulator, the regulator comprising a valve, the valve configured to control simultaneously, at the operator's choice, a number, a size, a shape, an angle, and a direction of apertures within the regulator through which the fluid flows, the valve further comprising an exterior portion (a) connecting to an exterior wall of the straw device and (b) a mechanism for manipulating by hand the exterior portion when the straw device is in use.

2. The drinking straw device according to claim 1, the second end portion mouthpiece comprising multiple apertures.

3. The drinking straw device according to claim 2, wherein each of the second end portion apertures has a diameter less than about one-third of the diameter of the first straw end portion aperture.

4. The drinking straw device according to claim 1, being a confection that is at least partially edible.

5. The drinking straw device according to claim 4, wherein, when the straw device is in use, a suctioned flow of a liquid up through the single first end portion mouthpiece aperture, through the bore, through flow regulator, through the second end portion mouthpiece, and out through the plurality of second end apertures forms a plurality of confection-flavored streams of the liquid that passes through the second end portion mouthpiece apertures.

6. The drinking straw device according to claim 4, wherein the drinking straw device is a confection, and the second end portion mouthpiece is in a shape of a fruit that corresponds to the flavor of the confection.

7. The drinking straw device according to claim 4, in which the device is of two-piece construction.

8. The drinking straw device according to claim 1, being heart-shaped.

9. The drinking straw device according to claim 1, being an integral bracelet.

10. The drinking straw device according to claim 1, comprising at least a partially external flow regulator.

11. The drinking straw device according to claim 10, comprising a fully external flow regulator.

12. The drinking straw device according to claim 1, comprising a bore in a shape that corresponds to the shape of a feature of the drinking straw device or to the shape of an aperture of the drinking straw device.

13. The drinking straw device according to claim 1, having multiple second end portion mouthpiece apertures of the same size or shape.

14. The drinking straw device according to claim 1, having multiple second end portion mouthpiece apertures in different sizes, shapes, or placement, or apertures in any combination of sizes, shapes, or placement.

15. The drinking straw device according to claim 1, further comprising a supplemental mouthpiece.

16. The drinking straw device according to claim 1, comprising an external shape in the form of a plant, animal, mineral, cartoon character, or any other object, the shape being attached to an exterior surface of the shaft of the drinking straw device.

17. The drinking straw device according to claim 1, comprising a drinking straw cap regulator, the drinking straw cap regulator further comprising a supplemental mouthpiece with multiple apertures.

18. The drinking straw device according to claim 1, wherein, when the straw device is in use, a suctioned flow of a liquid up through the single first end portion mouthpiece aperture, through the bore, through the second end portion mouthpiece, and out through the plurality of second end apertures forms a plurality of different streams of the liquid that passes through the second end portion mouthpiece apertures.

19. A drinking straw device according to claim 1, wherein the flow regulator is a cap with multiple apertures, the cap portion further being interchangeably detachable and reattachable to the drinking straw device.

20. The drinking straw device according to claim 1, wherein the drinking straw device is bendable.

21. The drinking straw device according to claim 1, in which the device is of two-piece construction.

* * * * *